US006678491B2

(12) United States Patent
Kido et al.

(10) Patent No.: US 6,678,491 B2
(45) Date of Patent: Jan. 13, 2004

(54) OPTICAL ELECTRIC CHARGE REMOVAL DEVICE AND IMAGE FORMATION APPARATUS INCLUDING THE SAME

(75) Inventors: Eiichi Kido, Nara (JP); Toshiaki Ino, Nara (JP); Takayuki Yamanaka, Nara (JP); Toshio Yamanaka, Osaka (JP); Hideaki Kadowaki, Kyoto (JP); Mitsuyoshi Terada, Osaka (JP); Kaori Fujii, Nara (JP); Takashi Kitagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/097,142

(22) Filed: Mar. 13, 2002

(65) Prior Publication Data

US 2002/0172530 A1 Nov. 21, 2002

(30) Foreign Application Priority Data

Mar. 14, 2001 (JP) ..... 2001-073195

(51) Int. Cl.[7] ..... G03G 21/00

(52) U.S. Cl. ..... 399/128; 399/113

(58) Field of Search ..... 399/128, 111, 399/113

(56) References Cited

U.S. PATENT DOCUMENTS 4,534,641 A * 8/1985 Gilliland et al. ..... 399/128
6,400,918 B1 * 6/2002 Ishii et al. ..... 399/149

FOREIGN PATENT DOCUMENTS

JP 62-127786 6/1987
JP 10-133036 5/1998

* cited by examiner

*Primary Examiner*—Quana M. Grainger
(74) *Attorney, Agent, or Firm*—David D. Conlin; William J. Daley, Jr.; Edwards & Angell, LLP

(57) ABSTRACT

An optical electric charge removal device mountable on an image formation apparatus of an electrophotographic system for removing residual charges on a photosensitive member by light irradiation is provided. The optical electric charge removal device includes a point light source provided in the image formation apparatus; and an optical conductor, mountable on a process cartridge which is detachable from the image formation apparatus, for guiding light incident from the point light source to the photosensitive member.

16 Claims, 25 Drawing Sheets

OPTICAL ELECTRIC CHARGE REMOVAL DEVICE AND IMAGE FORMATION APPARATUS INCLUDING THE SAME

BACKGROUND OF THE INVENTION

1. Field of the Invention

The present invention relates to an optical electric charge removal device used in an image forming process of an electrophotographic system for removing residual electric charges on a photosensitive member using light irradiation, and an image formation apparatus, such as a copier or the like, including the same.

2. Description of the Related Art

As is well known, an image formation apparatus of an electrostatic photographic system forms an image by a process including the steps of charging, exposure, development, transfer and fixing. In the case of a copier, for example, the above steps in more detail are as follows. First, a surface of a photosensitive member (photosensitive drum) is uniformly supplied with electric charges by a charger. The surface of the photosensitive member is exposed, by an optical system, to light which is reflected by an original image, thus forming an electrostatic latent image on the surface. Toner (developer) is electrostatically attached so as to develop the electrostatic latent image, thereby forming a toner image on the photosensitive member. Then, electrostatic charges having an opposite polarity to that of the toner is applied to a transfer member, and thus the toner image is transferred on a recording sheet. The transferred toner image is fixed on the recording sheet by heating and pressurizing. In this manner, an image corresponding to the original image is formed on the recording sheet.

To the above-described basic structure of a copier, many functional elements have been added for the purpose of improving the image quality and the image forming efficiency. One example of such functional elements is an optical electrostatic removal device for removing residual electric charges on the photosensitive member by light irradiation. Exemplary optical electric charge removal devices applicable to the above-described copier of an electrophotographic process include an eraser for erasing a defective latent image in a non-image area on the photosensitive member before the development step, a pre-transfer electric charge removal lamp (PTL) for optically reducing the potential of the photosensitive member before the transfer step, and an electric charge removal lamp (QL) for removing residual charges on the photosensitive member after the surface of the photosensitive member is cleaned.

As an irradiating light source used for such an optical electric charge removal device, a discharge tube such as a fluorescent tube or the like, or an LED array 3 shown in FIG. 25 is used. The LED array 3 includes a great number of LED chips 2 lined on a substrate 1. Especially recently, such LED arrays are widely used due to an increasing demand for more compact and more inexpensive products. As shown in FIG. 26, the LED array 3 includes the LED chips 2 arranged densely. Due to such a structure, the LED array 3 can irradiate a surface of a photosensitive drum 4 substantially uniformly and at a high luminance. However, such a structure uses a great number of LED chips 2 and thus cannot sufficiently reduce the costs.

For example, Japanese Laid-Open Utility Model Publication No. 55-35584 proposes combining a light bulb used as an irradiating light source and an optical conductor formed of a fluorescent light emitting material so as to provide an optical electric charge removal device for irradiating the surface of a photosensitive drum with light to remove residual charges after the surface is cleaned.

Although not regarding an optical electric charge removal device for removing residual charges, the following publications disclose irradiation devices.

Japanese Laid-Open Patent Publication No. 8-43633 discloses an irradiation device including a light source provided at an end and a column-shaped optical conductor formed of a light-transmissive material. The optical conductor includes a light outgoing surface provided on a side surface extending along a longitudinal direction, and a light scattering section provided on a surface facing the side surface. The light scattering section is formed by machining or surface-roughening.

Japanese Laid-Open Patent Publication No. 10-133026 discloses an irradiation device which includes an optical conductor formed of a rod-shaped light-transmissive material. The optical conductor includes an end for receiving light emitted by an LED as a light source and a light outgoing surface provided on a side surface extending along a longitudinal direction. The optical conductor further includes a sawtooth-like area facing the side surface for reflecting and scattering incident light.

Recently, image formation apparatuses of an electrophotographic system adopt a cartridge system in order to reduce the size of the apparatuses and facilitate maintenance. According to this system, a photosensitive member, a charger, a developing section, a cleaner and other elements used for forming an image are integrated into a unit or a process cartridge which is detachable from a main body.

This cartridge system has the following problems. (1) Such a process cartridge is discarded once toner accommodated therein is used up. Therefore, the light bulb as an irradiating light source is also discarded even though the light bulb is recyclable. (2) Mounting the optical electric charge removal device including the above-described LED array on such a disposable process cartridge is unreasonable in terms of cost, resource and energy savings and environmental protection. (3) Since the main body and the process cartridge are coupled to each other via a connector, the system involves an undesirable possibility of malfunction being caused by defective connection of electric circuits. (4) Use of a plurality of LED chips requires a relatively high power consumption for driving the optical electric charge removal device.

The technology disclosed by Japanese Laid-Open Utility Model Publication No. 55-35584 has the following problems. An electric bulb is used as an irradiating light source. Therefore, the power consumption is relatively high, and an optical conductor formed of a fluorescent light emitting material is required for amplifying the irradiating light. In addition, the irradiating light source and an optical conductor of an optical electric charge removal device, which are secured to the main body of the image formation apparatus, are relatively large and are difficult to accommodate in a process cartridge. Especially where such an optical electric charge removal device is secured to a main body of a tandem-system color image formation apparatus including a plurality of process cartridges arranged in parallel, the optical electric charge removal device is too large to be conveniently attached to the color image formation apparatus. Even when the optical electric charge removal device is reduced in size to be attached to the apparatus, malfunction is likely to occur due to defective connection in a power supply circuit for the irradiating light source, for example, in a connection part between the image formation apparatus and the process cartridge. In addition, after the toner in the process cartridge is used up, the irradiating light source, the optical conductor and the like are discarded even through they are still usable. This is unreasonable in terms of resource and energy savings and environmental protection.

The technologies disclosed by Japanese Laid-Open Patent Publication Nos. 8-43633 and 10-133026 are applied to an optical image reading device (i.e., so-called hand-scanner). According to these technologies, the irradiating light source and the optical conductor are integrated together or provided as close as possible to each other. Since a power source for driving the light source is supplied via a cable or another appropriate element, electricity-related troubles such as defective connection or the like hardly occur. However, when the irradiating light source and the optical conductor are mounted on the cartridge for the purpose of facilitating the periodical maintenance work or other service-related works, troubles such as defective connection in a power supply circuit occur. In addition, after the toner in the process cartridge is used up, the irradiating light source, the optical conductor and the like are discarded even through they are still usable. This is unreasonable in terms of resource and energy savings and environmental protection.

SUMMARY OF THE INVENTION

According to one aspect of the invention, an optical electric charge removal device, mountable on an image formation apparatus of an electrophotographic system, for removing residual charges on a photosensitive member by light irradiation is provided. The optical electric charge removal device includes a point light source provided in the image formation apparatus; and an optical conductor, mountable on a process cartridge which is detachable from the image formation apparatus, for forming an optical path for guiding light incident from the point light source to the photosensitive member.

In one embodiment of the invention, the point light source includes an LED lamp provided so as to face a leading end surface of the process cartridge inserted into the image formation apparatus, the point light source being located so as to face a non-image area of the photosensitive member.

In one embodiment of the invention, the optical conductor is formed of a light-transmissive material. The optical conductor has a smooth light incident surface for receiving light incident from the point light source and a smooth light outgoing surface from which the light exits the photosensitive member. The optical conductor has a light reflecting surface which faces the light outgoing surface and is roughened or provided with a whitened adhesive tape.

In one embodiment of the invention, the optical conductor is mounted on the process cartridge by a separable connection device.

In one embodiment of the invention, the optical conductor has a shape of a strip extending parallel to the photosensitive member. A leading end surface of the optical conductor inserted into the image formation apparatus faces the point light source so as to act as a light incident surface. A side surface of the optical conductor substantially perpendicular to the leading end surface and facing the photosensitive member acts as a light outgoing surface. A side surface of the optical conductor facing the light outgoing surface becomes closer to the light outgoing surface from the leading end surface toward a rear surface opposite to the leading end surface, and acts as a light reflecting surface for guiding light incident on the light incident surface to the light outgoing surface.

In one embodiment of the invention, the point light source faces the light incident surface, and has an optical axis which passes through an intersection of the light reflecting surface and the rear surface.

According to another aspect of the invention, an optical electric charge removal device, mountable on an image formation apparatus of an electrophotographic system, for removing residual charges on a photosensitive member by light irradiation is provided. The optical electric charge removal device includes a point light source provided in the image formation apparatus; an optical conductor, provided separately from the point light source, for forming an optical path for guiding light incident from the point light source to the photosensitive member; and a support member for supporting the optical conductor at a position where only a light incident surface of the optical conductor contacts the point light source and the optical conductor is out of contact with the image formation apparatus, the support member being provided so as to face an area of the photosensitive member outside of an image area.

In one embodiment of the invention, the optical conductor is mounted on a process cartridge detachable from the image formation apparatus, and the supporting member is provided on an area of the process cartridge which faces an area of the photosensitive member outside of an image area.

In one embodiment of the invention, the optical conductor is detachable from the process cartridge.

In one embodiment of the invention, the optical electric charge removal device further includes a light blocking member, formed of a flexible and elastic material, for blocking the light from the point light source from being incident on an element other than the optical conductor.

In one embodiment of the invention, the optical electric charge removal device further includes a light blocking member for blocking the light from the point light source from being incident on an element other than the optical conductor, the light blocking member being movable to be closer to or farther from the light incident surface of the optical conductor.

In one embodiment of the invention, the optical electric charge removal device further includes a light blocking member integrally formed with the point light source. An assembly of the point light source and the light blocking member is movable to be closer to or farther from the light incident surface of the optical conductor.

According to still another aspect of the invention, an image formation apparatus including any of the above-described an optical electric charge removal device is provided.

According to the present invention, a point light source is used for light irradiation, and the light from the point light source is guided to a photosensitive member (photosensitive drum) via an optical conductor. Thus, the production costs of the components and power consumption are reduced. The point light source is provided in the image formation apparatus, and the optical conductor is mounted on a disposable process cartridge. With such an arrangement, the point light source can be used for its full life and thus is not wastefully discarded. Therefore, this reduces the production costs of the components are reduced and, further, malfunction of the optical electric charge removal device caused by electricity-related troubles such as defective connection of electric circuits are unlikely to occur. The reliability of the optical electric charge removal device is thus improved.

The optical conductor contaminated with toner or the like can be detached from the image formation apparatus while being accommodated in the process cartridge. Therefore, the optical conductor can be cleaned by not just a specialized maintenance personnel. Although the optical conductor is not exhausted, the optical conductor is detached while accommodated in the process cartridge when, for example, the life of the developer is expired, and is replaced with a new optical conductor not contaminated with toner or the like. As compared to the case where the optical conductor is secured in the image formation apparatus, the reduction in electric charge removal ability due to contamination of the optical conductor is minimized. Therefore, the residual charges on the photosensitive member are removed with certainty so as to always perform high quality image formation.

It is conceivable that provision of a light source in each of a plurality of light irradiation locations is advantageous since the loss caused by the optical conductor is smaller and power consumption is lower. However, a conventional image formation apparatus, like ARC-150 color copiers produced by Sharp Kabushiki Kaisha, includes a plurality of LEDs on a substrate and a filtering plate between the LEDs and the photosensitive member, in order to uniformize and reduce the amount of light directed to the photosensitive member. A large number of LEDs are provided for uniformizing the amount of light used for removing the electric charges. However, this results in the total amount of light being excessive. Therefore, the filtering plate is provided for reducing the amount of light reaching the photosensitive member. This system loses a significant amount of power in order to uniformize the amount of light. It is not easy to amplify the amount of light but it is easy to reduce the amount of light. Therefore, an amount of light larger than the necessary amount is first provided, and then the amount of light is reduced to the necessary level.

A color copier is required to provide a higher quality image than a monochrome copier, and the amount of light used for removing the electric charges is also required to be highly uniform. Therefore, wastage of electric power is tolerated in this system.

Recently, a super high luminance LED has been developed as a light source for automatic exposure of cameras, and thus the light emitting efficiency is improved. Therefore, in the case where an optical conductor is considered to be a cause of a loss in light amount and an increase in the power consumption, such a super high luminance LED can be used as the light source.

In one embodiment of the invention, the point light source is provided so as to face a non-image area of the photosensitive member. Even in a structure where the point light source does not directly face the photosensitive member in the longitudinal direction of the optical conductor, the point light source is likely to be contaminated with toner when it is provided so as to face an image area of the photosensitive member in a direction perpendicular to the longitudinal direction of the optical conductor. When this occurs, the electric charge removal efficiency is likely to decrease. By contrast, when the point light source is provided so as to face a non-image area of the photosensitive member, the point light source is unlikely to be contaminated with toner, and thus the electric charge removal efficiency is prevented from decreasing. Further, even a point light source, when provided so as to face an image area, interferes with the other elements. To avoid the interference, the image formation apparatus needs to be disadvantageously enlarged. Provision of the point light source so as to face a non-image area is advantageous in reducing the size of the image formation apparatus. In addition to the advantage regarding the arrangement of the components, provision of the point light source so as to face a non-image area minimizes the influence of the point light source on the other steps of the image formation process including charging and exposure. As the point light source, an inexpensive and easily available component such as an LED lamp is usable. When an LED is used, the power consumption is reduced, and the size of the image formation apparatus is reduced. Thus, a highly reliable optical electric charge removal device can be realized. An LED has a long life and reaches a stable operating state within a short period of time. In the case where a feeds sphere or the like having a relatively wide range of emission wavelengths is used as a light source, the optical design of the optical electric charge removal device can be disadvantageously more complicated. By contrast, the LED has a single wavelength and thus simplifies the optical design.

In one embodiment of the invention, the optical conductor of the optical electric charge removal device is formed of an inexpensive and easily available light-transmissive material such as an acrylic resin. When such a material is used, the power consumption is reduced, and the size of the image formation apparatus is reduced. A light reflective surface of the optical conductor can be provided with a highly reflective film by aluminum vapor deposition, coating, printing or the like. Alternatively, a light reflecting/scattering surface can be easily obtained by forming a convex and concave surface, for example, a prism-cut surface or bonding a whitened tape. Thus, even the optical conductor has an obtuse inclining angle (i.e., even the light reflecting surface of the optical conductor is generally parallel to the light outgoing surface), the optical path from the point light source can be bent at 90 degrees. When each of a plurality of areas of the prism-cut surface is finished to be sufficiently smooth, the light incident on the optical conductor mostly exits from the light outgoing surface, so that a sufficient amount of light is obtained at the light outgoing surface.

In the case where the light incident surface of the optical conductor is rough or convex and concave, the light is scattered or reflected by the light incident surface and partially leaks to the outside of the optical conductor. Therefore, the light incident surface is preferably smooth. The light outgoing surface is also preferably smooth for the same reason.

In one embodiment of the invention, a separable connection device is used for securing the optical conductor to the process cartridge. Due to such a structure, even when the optical conductor is contaminated with scattered toner, the optical conductor only can be removed from the process cartridge and cleaned after the process cartridge is detached from the image formation apparatus. Even when the optical conductor is accommodated in a disposable process cartridge, the optical conductor can be easily separated from the process cartridge in a recycle process as long as the optical conductor does not have any significant damage such as a scratch or crack. In this case, the oils, toner or the like are removed from the optical conductor and the optical conductor is recycled.

In one embodiment of the invention, light, which is incident on a leading end surface of the optical conductor acting as a light incident surface, is reflected by a light reflecting surface extending along a longitudinal direction of the optical conductor. Thus, the light is caused to exit the light outgoing surface facing the light reflecting surface. In this manner, an inexpensive optical electric charge removal device for uniformly irradiating the surface of the photosensitive member can easily be realized.

When the light reflecting surface and the light outgoing surface are parallel to each other as shown in FIG. 21A, the amount of light exiting the light outgoing surface is smaller at a position closer to the rear end than at a position closer to the light incident surface. Namely, the amount of light exiting the light outgoing surface is non-uniform along the longitudinal direction of the optical conductor. In order to prevent this non-uniformity, it is preferable to provide the light reflecting surface to be closer to the light outgoing surface toward the rear end as shown in FIG. 21B.

In one embodiment of the invention, the point light source is provided so as to face the leading end surface of the optical conductor and so that an optical axis thereof passes through an intersection of the light reflecting surface and the rear surface. Due to such positioning, the light utilization efficiency of the point light source can be improved.

In one embodiment of the invention, the point light source is provided in contact with the light incident surface of the optical conductor. Therefore, the light from the point light source can be efficiently guided to the optical conductor. The point light source is also out of contact (in a floating state) with nearby elements in the image formation apparatus. Therefore, the incident light can be guided to the surface of the photosensitive member through the light outgoing surface of the optical conductor without the optical path being blocked. It is not preferable to provide a support member for the optical conductor so as to face an image area of the photosensitive member or so as to be in contact with the nearby elements of the image formation apparatus. The reason is because such an arrangement blocks the optical path and prevents the light used for removing the electric charges from being efficiently guided to the photosensitive member. Regarding the positional relationship between the optical conductor and the photosensitive member in the image formation apparatus, the distance between the light outgoing surface of the optical conductor and the photosensitive member is preferably as small as possible for effectively guiding the light for removing the electric charges. However, it is practically impossible to make the distance zero so that the optical conductor contacts the photosensitive member. By providing the support member for the optical conductor in an area facing a non-image area of the photosensitive member outside the image area, the optical conductor can be detachable. The optical conductor is separate from the point light source, and thus the point light source does not need to be detached even when the optical conductor is detached. Therefore, the electricity-related troubles such as defective connection are unlikely to occur, and the influence of the point light source on the optical path can be minimized. The light from the point light source does not reach the non-image area of the photosensitive member. Therefore, even when the residual charges on the photosensitive member are not completely removed, no inconvenience occurs in image formation. As a result, an optical electric charge removal device having improved reliability is obtained.

In one embodiment of the invention, the optical conductor is mounted on a process cartridge detachable from the image formation apparatus. Therefore, the operability of the optical electric charge removal device can be improved.

In one embodiment of the invention, the optical conductor can be removed from the process cartridge for maintenance. Therefore, the operability of the optical electric charge removal device can be improved.

In one embodiment of the invention, the point light source for light irradiation is covered with a light blocking member. Due to such a structure, the light from the point light source can be efficiently guided to the light incident surface of the optical conductor without the light being scattered. The light blocking member is formed of a flexible and elastic material. Therefore, even in a structure where the point light source is provided in the main body of the image formation apparatus and the optical conductor is separately mounted on the detachable process cartridge, an optical path can be formed with certainty so as to guide the light emitted by the point light source to the light incident surface of the optical conductor. The adverse influences, caused by the point light source and the optical conductor being separately provided, on the assembly precision of the image formation apparatus and the process cartridge, and the positioning precision of attachment of the process cartridge to the image formation apparatus, are eliminated.

In one embodiment of the invention, the point light source for light irradiation is covered with a light blocking member. Due to such a structure, the light from the point light source can be efficiently guided to the light incident surface of the optical conductor without the light being scattered. The light blocking member is movable to be closer to or farther from the light incident surface of the optical conductor by the urging force of an elastic member. Therefore, even in a structure where the point light source is provided in the main body of the image formation apparatus and the optical conductor is separately mounted on the detachable process cartridge, an optical path can be formed with certainty so as to guide the light emitted by the point light source to the light incident surface of the optical conductor. The adverse influences, caused by the point light source and the optical conductor being separately provided, on the assembly precision of the image formation apparatus and the process cartridge, and the positioning precision of attachment of the process cartridge to the image formation apparatus, are eliminated.

In one embodiment of the invention, the point light source for light irradiation is covered with a light blocking member. Due to such a structure, the light from the point light source can be efficiently guided to the light incident surface of the optical conductor without the light being scattered. The light blocking member and the point light source are integrally formed. An assembly of the point light source and the light blocking member is movable to be closer to or farther from the light incident surface of the optical conductor by the urging force of an elastic member. Therefore, even in a structure where the point light source is provided in the main body of the image formation apparatus and the optical conductor is separately mounted on the detachable process cartridge, an optical path can be formed with certainty so as to guide the light emitted by the point light source to the light incident surface of the optical conductor. The adverse influences, caused by the point light source and the optical conductor being separately provided, on the assembly precision of the image formation apparatus and the process cartridge, and the positioning precision of attachment of the process cartridge to the image formation apparatus, are eliminated.

An image formation apparatus including the above-described optical electric charge removal device is also reduced in production costs and power consumption, and is efficient.

Thus, the invention described herein makes possible the advantages of providing (1) an optical electric charge removal device effectively using elements thereof and achieving a high reliability, and an image formation apparatus including the same; and (2) a compact and reliable optical electric charge removal device for reducing the power consumed by an irradiating light source and reducing the electricity-related troubles such as defective connection, and an image formation apparatus including the same.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

Figure 1:
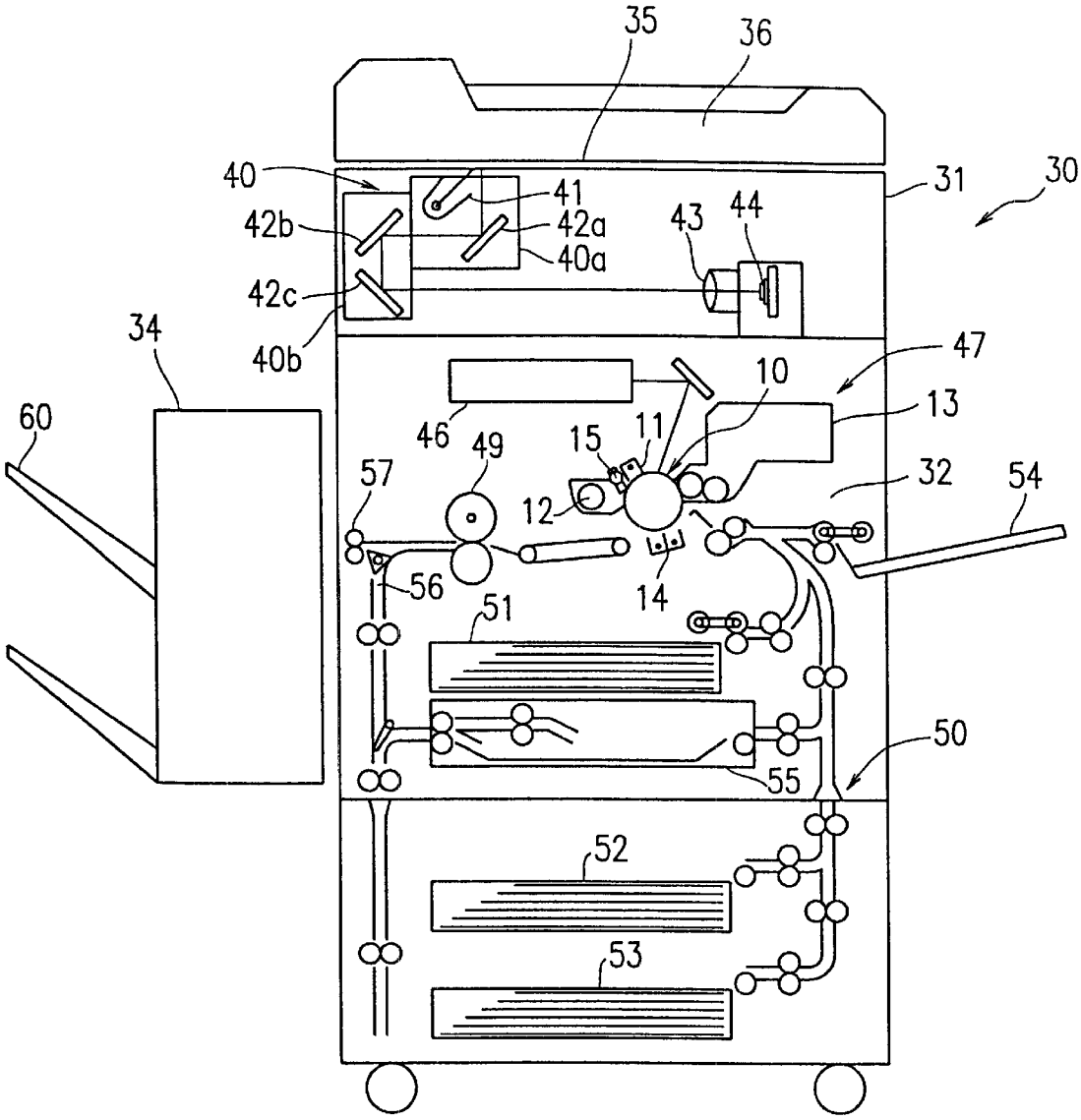
FIG. 1 is a cross-sectional view illustrating an overall structure of an image formation apparatus according to a first example of the present invention.

FIG. 1 shows an overall structure of a composite digital image formation apparatus 30 according to a first example of the present invention. The composite digital image formation apparatus 30 has facsimile, copying and printing functions, and roughly includes a scanner section 31, an image formation section 47 and a post-processing section 34. Hereinafter, the composite digital image formation apparatus 30 will be referred to as the "image formation apparatus 30".

The scanner section 31 is provided, as an image input device in the image formation apparatus 30, for reading an original document. The scanner section 31 includes a document table 35, a recirculating automatic document feeder (hereinafter, referred to as an "RADF") 36, and a scanner unit 40. The scanner section 31 reads an image of each of the documents placed on the document table 35 one by one.

The RADF 36 feeds the documents on a prescribed document tray (not shown) one by one. After the scanner unit 40 reads an image of a document, the RADF 36 discharges the document to a prescribed position. Alternatively, after the scanner unit 40 reads an image of a document, the RADF 36 can turn the document over and feed the document back to the document table 35. A detailed structure of the RADF 36 is well known and will not be described herein.

The scanner unit 40 reads an image of a document on the document table 35 in the direction of a scanning line unit by unit. The scanner unit 40 includes a first scanning unit 40*a*, a second scanning unit 40*b*, an optical lens 43 and a CCD 44 as an electro-optic conversion device. The first scanning unit 40*a* exposes the document while moving along the document table 35 from left to right in the sheet of FIG. 1 at a constant speed V. As shown in FIG. 1, the first scanning unit 40*a* includes a lamp reflector assembly 41 for irradiating a document with light, and a first reflective mirror 42*a* for guiding the light reflected by the document to the second scanning unit 40*b*. The second scanning unit 40*b* follows the first scanning unit 40*a* to move at a speed of V/2. The second scanning unit 40*b* includes a second reflective mirror 42*b* and a third reflective mirror 42*c* for guiding the light from the first reflective mirror 42*a* to the optical lens 43 and the CCD 44. The optical lens 43 focuses the light reflected by the third reflective mirror 42*c* on the CCD 44. The CCD 44 converts the light focused by the optical lens 43 into an electric signal. An analog electric signal obtained by the CCD 44 is converted into digital image data. The digital image data is then subjected to various types of image processing and transported to the image formation section 47 via a buffer memory or another appropriate means.

The image formation section 47 includes an image creation unit 32, a laser writing unit 46 and a sheet feeding section 50. The laser writing unit 46 includes, for example, a semiconductor laser light source for emitting laser light in correspondence with the image data which is read from a buffer memory or transported from an external apparatus, a polygon mirror for deflecting the laser light at an equal angular velocity, and an f-θ lens for correcting the laser light deflected at the equal angular velocity so as to be further deflected at an equal angular velocity on a photosensitive drum 10 included in the image creation unit 32. The elements included in the laser writing unit 46 are not shown.

Figure 2:
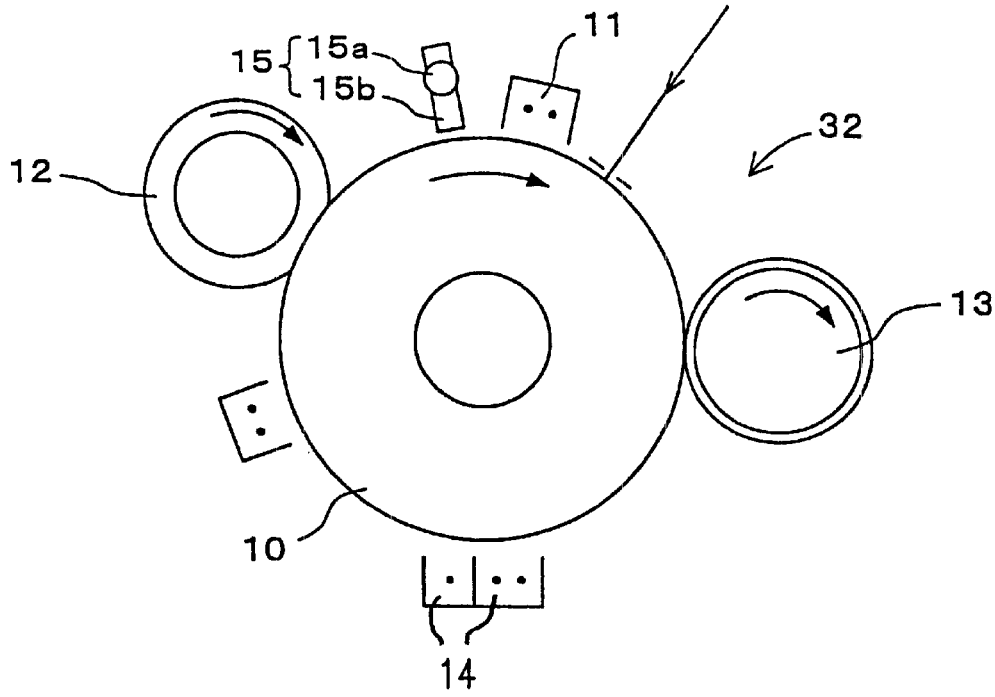
FIG. 2 illustrates an image creation unit in the image formation apparatus shown in FIG. 1.

FIG. 2 shows a structure of the image creation unit 32. As shown in FIG. 2, the image creation unit 32 includes the photosensitive drum 10 which is well known, and the following elements provided around the photosensitive drum 10: a charger 11 for charging the photosensitive drum 10 to a prescribed potential, a developing device 13 for supplying an electrostatic latent image formed on a surface of the photosensitive drum 10 with toner so as to develop the electrostatic latent image into a toner image, a transfer device 14 for transferring the toner image formed on the surface of the photosensitive drum 10 to a recording sheet, a cleaning device 12 for recovering excess toner, and an optical electric charge removal device 15. The toner image transferred on the recording sheet in the image creation unit 32 is heated by a fixing unit 49 (FIG. 1) to be fixed on the recording sheet.

Returning to FIG. 1, the image formation section 47 also includes the following elements on the discharge side beyond the image creation unit 32, in addition to the fixing unit 49: a switch back path 56 for turning the recording sheet over so as to allow another image to be formed on the rear surface of the recording sheet, and the post-processing section 34 for stapling a plurality of recording sheets having images formed thereon. The post-processing section 34 includes an elevation tray 60. A recording sheet having a toner image fixed thereon by the fixing unit 49 is fed to the post-processing section 34 via a charging roller 57, subjected to prescribed post-processing and then discharged from the image formation apparatus 30.

The sheet feeding section 50 is provided below the image creation unit 32, and includes a manual feeding tray 54, a multi-side printing unit 55, a multi-stage sheet feeding tray section including sheet cassettes 51, 52 and 53, and a transporting section for transporting a sheet fed from one of the sheet cassettes 51, 52 and 53 or the manual feeding tray 54 to a transfer position at which the transfer device 14 is located in the image creation unit 32. The multi-side printing unit 55 is in communication with the switch back path 56 and is used for forming an image on both of two surfaces of the recording sheet.

Figure 3:
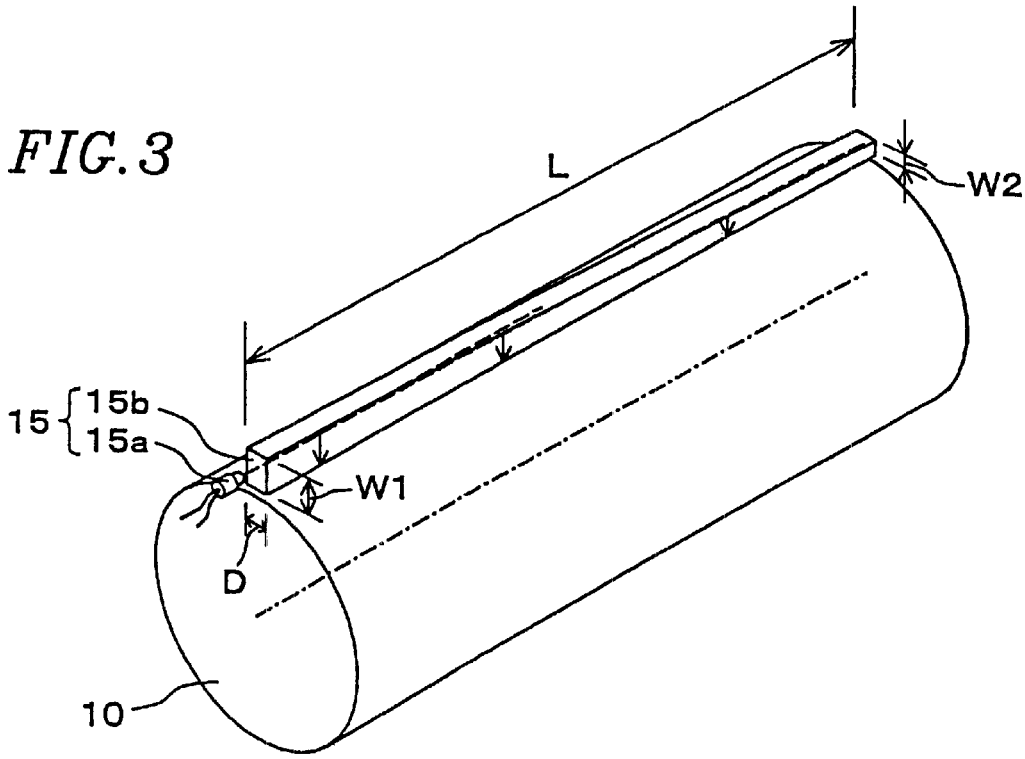
FIG. 3 is a perspective view illustrating a structure of an optical electric charge removal device in the optical electric charge removal device shown in FIG. 1.
Figure 4:
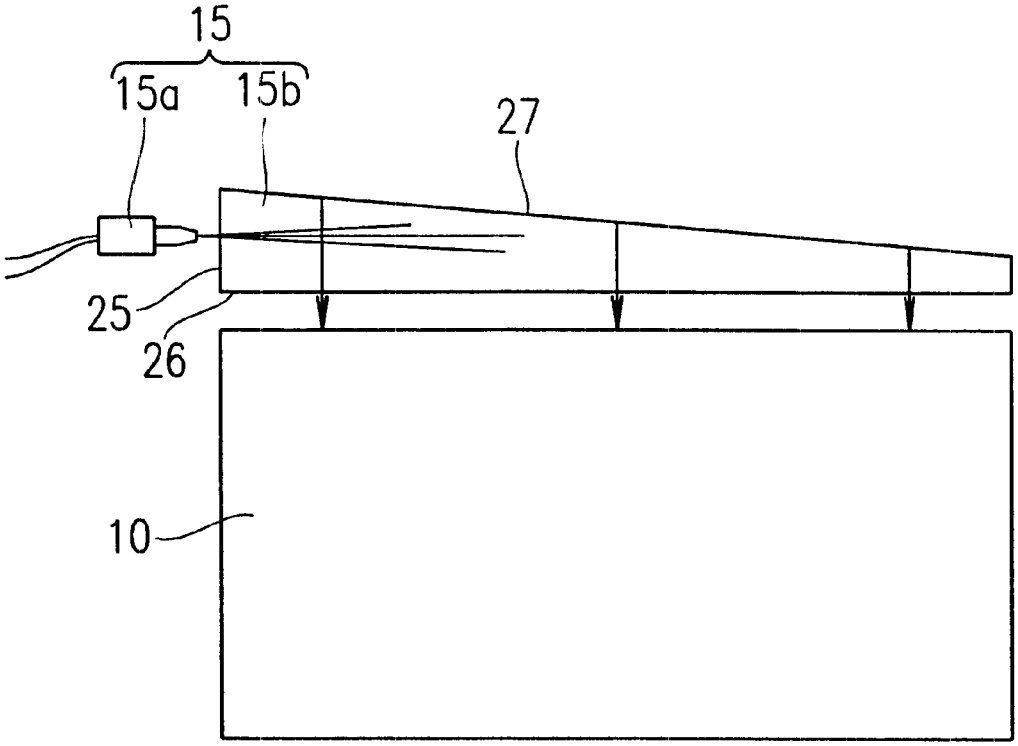
FIG. 4 is a front view of the optical electric charge removal device shown in FIG. 3.

FIG. 3 is a perspective view of the optical electric charge removal device 15, illustrating a structure thereof. FIG. 4 is a front view of the optical electric charge removal device 15. As shown in FIGS. 3 and 4, the optical electric charge removal device 15 includes an LED lamp 15*a* as a point light source and an optical conductor 15*b*.

Figure 5A:
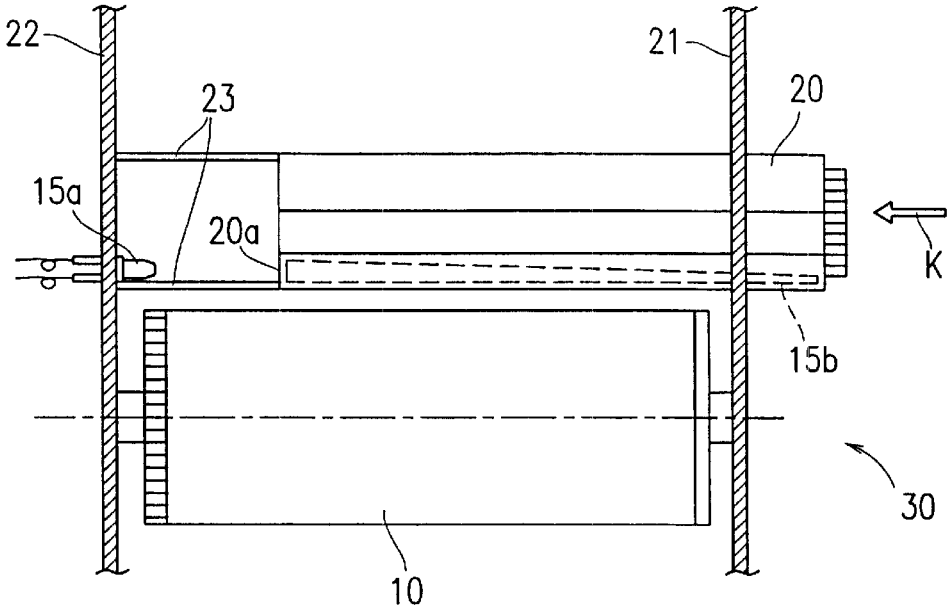
FIGS. 5A and 5B illustrate an attachment and detachment of a process cartridge to the image formation apparatus shown in FIG. 1.
Figure 5B:
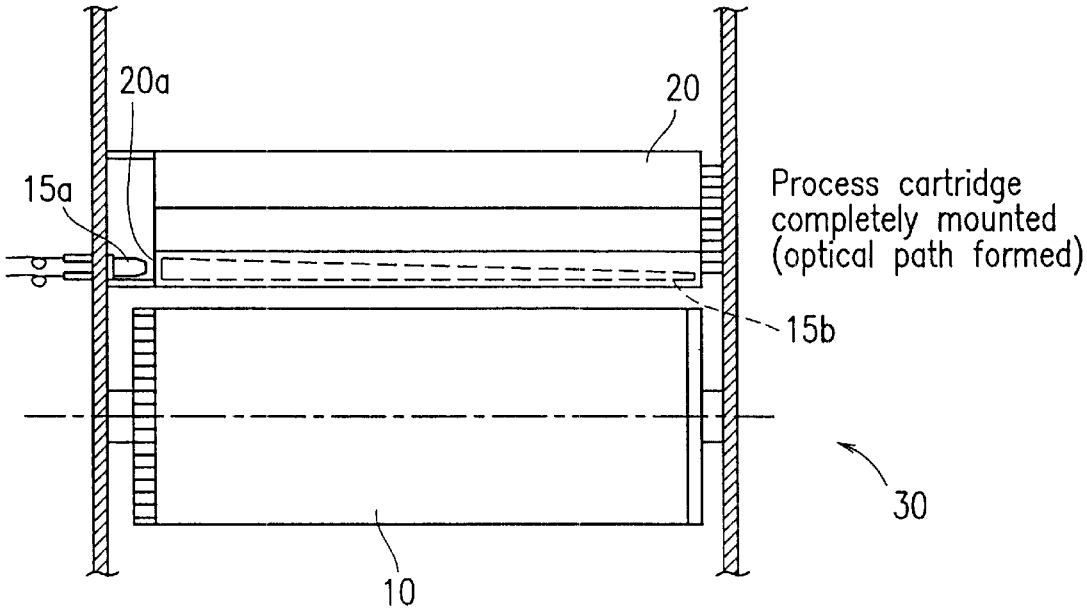

FIGS. 5A and 5B illustrate an attachment and detachment of a process cartridge 20 to and from the image formation apparatus 30. As shown in FIGS. 5A and 5B, the optical conductor 15*b* i s mounted on the process cartridge 20. The process cartridge 20 is slidable on cartridge guides 23 between a position shown in FIG. 5A (before the process cartridge 20 is inserted to the image formation apparatus 30 in a direction represented by arrow K) and a position shown in FIG. 5B. The cartridge guides 23 are extended between a front frame 21 and a rear frame 22 of the image formation apparatus 30. In this manner, the optical conductor 15*b* is attached to and detached from the image formation apparatus 30. A process cartridge usable in the present invention may accommodate a photosensitive drum 10, a cleaning member 12 for removing residual toner attached to the photosensitive drum 10, the transporting section for transporting the toner, the optical conductor for guiding light for removing electric charges on the surface of the photosensitive drum 10, and the charger 11 for supplying the surface of the photosensitive drum 10 with prescribed charges. Another process cartridge accommodating a toner storage section, a developing section for developing an electrostatic latent image formed on the photosensitive drum 10, a developer and the like may be usable. In the first example and a second example described below, the optical conductor 15*b* is supported by a supporting member as in a third example described below.

In the image formation apparatus 30, the LED lamp 15*a* faces a front end 20*a* of the process cartridge 20. The front end 20*a* is a leading end of the process cartridge 20 when the process cartridge 20 is inserted into the image formation apparatus 30.

Figure 6:
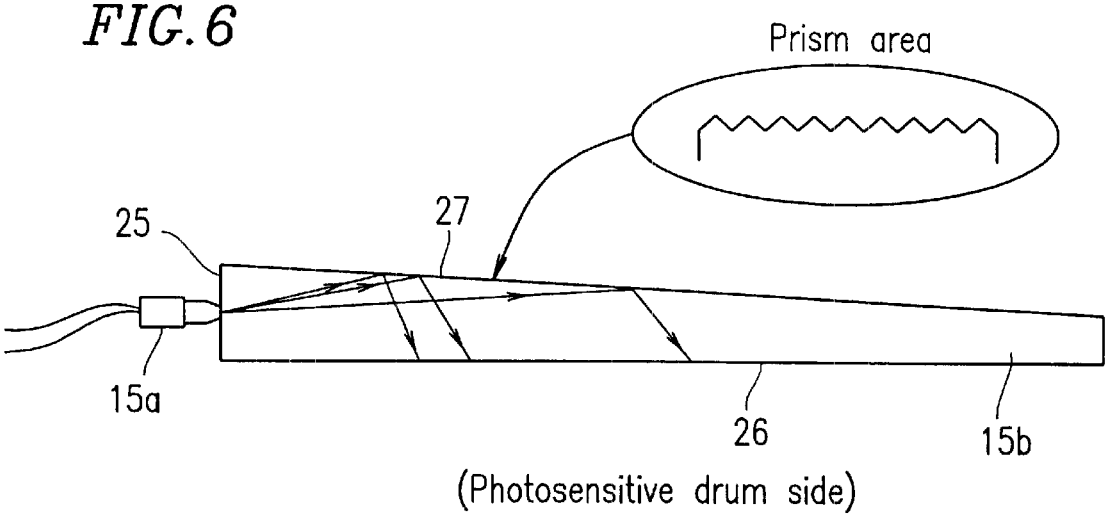
FIG. 6 illustrates a structure of the optical electric charge removal device shown in FIG. 4.
Figure 26:
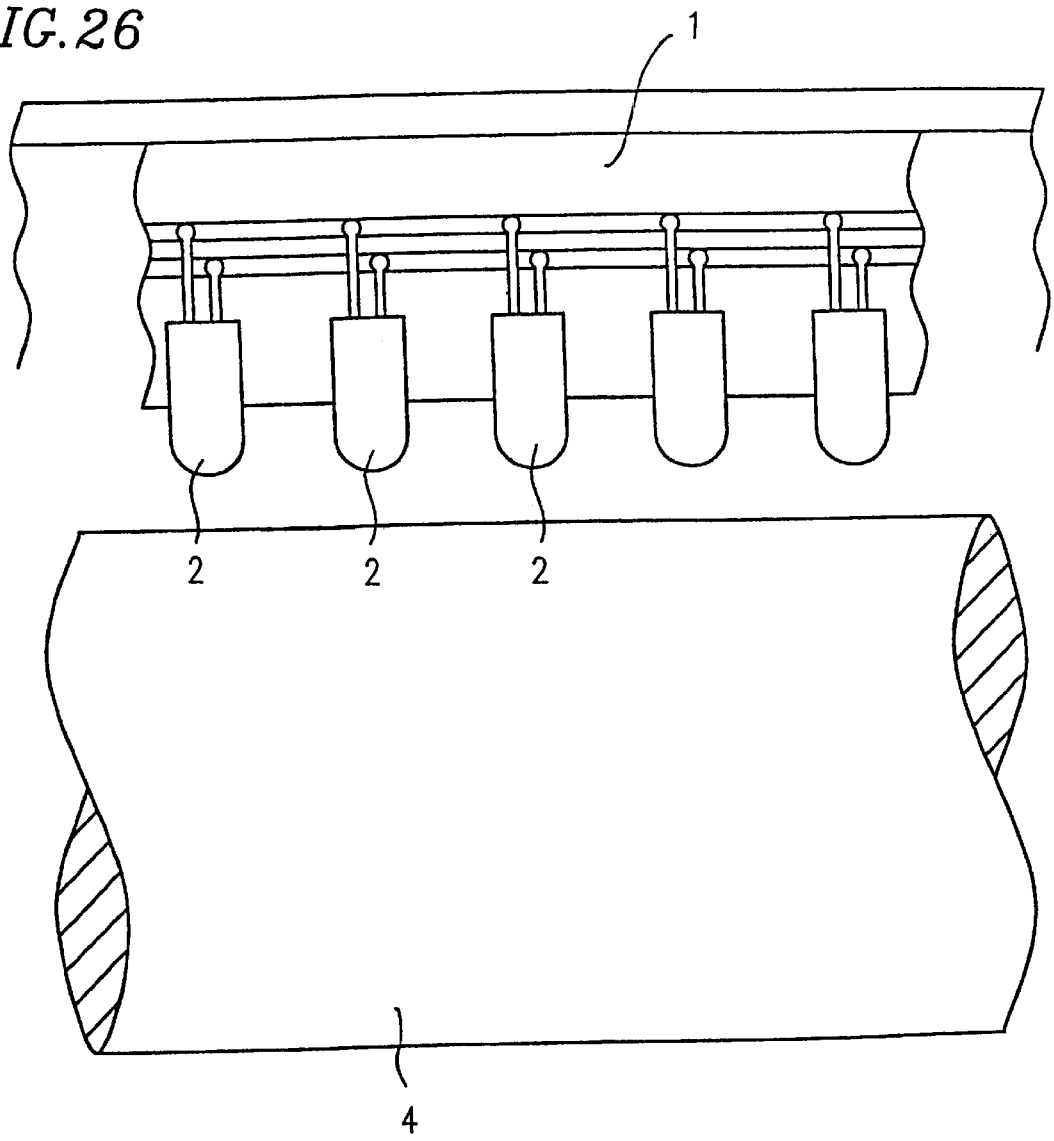
FIG. 26 illustrates a structure of a conventional optical electric charge removal device.

As shown in FIGS. 3 and 4, the optical conductor 15*b* has a shape of a strip extending parallel to the photosensitive drum 10. As shown in FIG. 4, a front end of the optical conductor 15*b* faces the LED lamp 15*a* and acts as a light incident surface 25. One side surface of the optical conductor 15*b* faces the photosensitive drum 10 and acts as a light outgoing surface 26. Another side surface of the optical conductor 15*b* facing the light outgoing surface 26 approaches the light outgoing surface 26 as it approaches from the light incident surface 25 to a rear end, and acts as a light reflecting surface 27 for guiding light incident on the light incident surface 25 to the light outgoing surface 26. The light outgoing surface 26 is perpendicular to the light incident surface 25. For example, the optical conductor 15*b* has a thickness D of 3 mm, a height W1 of the light incident surface 25 of 15 mm, a height W2 of the rear surface (facing the light incident surface 25) of 7.5 mm, and a longitudinal length L of 323 mm. The optical conductor 15*b* has a transmittance of the light from the LED lamp 15*a* of, for example, 80% or more, and a refractive index of 1.4 to 1.7. Even when the optical conductor 15*b* has a small inclining angle (angle between the light outgoing surface 26 and the light reflecting surface 27) as in this example, an optical path can be bent at 90 degrees by providing the light reflecting surface 27 with a light scattering prism area (as shown in FIG. 6) or a convex and concave area acting similarly to the light scattering prism area. In this case, the side surface facing the light outgoing surface 26 acts as a light scattering surface (hereinafter, referred to as the "light scattering surface 27" for the sake of convenience). As shown in FIG. 26, the LED chips 2 are lens-shaped in a light emitting section, and have a light divergence angle of 5 to 15 degrees.

Therefore, the scattering direction of the light which is scattered by the light scattering surface 27 after being incident on the optical conductor 15*b* from the LED chips 2 is controlled by the shape of the light scattering prism area. As a result, uniform light can be guided to the entirety of the light outgoing surface 26. A light scattering prism area maybe provided at the light outgoing surface 26 facing the photosensitive drum 10.

The optical conductor 15*b* is entirely smooth except for the light reflecting (or scattering) surface 27. The optical conductor 15*b* is formed of an acrylic resin, a polycarbonate resin, a polystyrene resin, a vinyl chloride resin, glass or the like by injection molding or extrusion molding. Polishing or other processing is performed on necessary areas. Alternatively, the optical conductor 15*b* may be first formed to be entirely smooth, and then a whitened two-sided adhesive tape may be bonded on the light reflecting (or scattering) surface 27. The optical conductor 15*b* may be the one described in, for example, Japanese Laid-Open Publication No. 8-43633 or 10-133026 which is used for a linear light source for optical reading.

The LED lamp 15*a* is produced by, for example, bonding a LED chip on each of a plurality of metal leads and sealing the LED chip with a transparent tape so as to obtain a lens shape. The LED lamp 15*a* is provided close to the light incident surface 25. The LED lamp 15*a* may use, for example, a super-high luminance lamp (Sharp Kabushiki Kaisha, GL5ZJ43) having a wavelength of 618 nm and an experimental resistance of 200 Ω. Only one LED lamp 15*a* is used, and light is introduced only from the front end 25 of the optical conductor 15*b*. Thus, the number of the LED lamps is reduced so as to decrease the production costs of the optical electric charge removal device 15.

The optical electric charge removal device 15 having the above-described structure uses an LED lamp 15*a* as a point light source for light irradiation and guides the light from the LED lamp 15*a* to the photosensitive drum 10 by the optical conductor 15*b*. Thus, the production costs of the components and power consumption are reduced. Since the LED lamp 15*a* is provided in the image formation apparatus 30, the LED lamp 15*a* can be used for the full life thereof. Therefore, the LED lamp 15*a* is not discarded as waste so as to further reduce the production costs, and also the chances of malfunction of the optical electric charge removal device 15 caused by the defective connection of electric circuits such as defective contact of a connector are reduced.

The optical conductor 15*b* is accommodated in the process cartridge 20 which is exchangeable as a disposable component. Therefore, when the optical conductor 15*b* is contaminated with toner or the like, the process cartridge 20 can be detached from the image formation apparatus 30 so that the optical conductor 15*b* can be cleaned by not just a specialized maintenance personnel.

Alternatively, the optical conductor 15*b* may be mounted on the process cartridge 20 in a fixing method which allows the optical conductor 15*b* to be easily separated from the process cartridge 20. In this case, at the time of maintenance, the process cartridge 20 can be removed from the image formation apparatus 30 so that the optical conductor 15*b* only is separated for cleaning. Even when the optical conductor 15*b* is accommodated in a disposable process cartridge 20, the optical conductor 15*b* can be easily separated from the process cartridge 20 in a recycle process as long as the optical conductor 15*b* does not have any significant damage such as a scratch or crack. In this case, the oils, toner or the like are removed from the optical conductor 15*b* and the optical conductor is recycled.

The optical conductor 15*b* can be made separable from the process cartridge 20 by a method of directly screwing the optical conductor 15*b* to an appropriate location of a frame of the process cartridge 20, a method of elastically holding the optical conductor 15*b* by a generally U-shaped spring, a hairpin-like clip or the like secured on the frame of the process cartridge 20, a method of supporting the optical conductor 15*b* by putting into engagement, a pin-like, boss-like or rib-like supporting members projecting on the frame of the process cartridge 20 and an attaching hole or groove of the optical conductor 15*b*, or other appropriate coupling methods.

The LED lamp 15*a* is provided so as to face a non-image area of the photosensitive drum 10, and therefore is unlikely to be contaminated with toner. The LED lamp 15*a* is thus effectively prevented from having its efficiency reduced. Even a point light source can be problematic when provided in an image area since the light source interferes with other elements used for image creation. A solution to solve such interferences may disadvantageously enlarge the image formation apparatus 30. In this example, since the LED lamp 15*a* is provided so as to face an on-image area, the image formation apparatus 30 can be reduced in size. Provision of the LED lamp 15*a* so as to face a non-image area can minimize the influence of the LED lamp 15*a* on the other steps of the image formation process including charging and exposure.

In this example, the LED lamp 15*a* is used as a point light source and the optical conductor 15*b* is formed of an inexpensive and easily available material such as, for example, an acrylic resin. Therefore, the optical electric charge removal device 15 in this example reduces the power consumption, and is compact and reliable. The LED lamp 15*a* has a long life and reaches a stable operating state within a short period of time.

EXAMPLE 2

Figure 7:
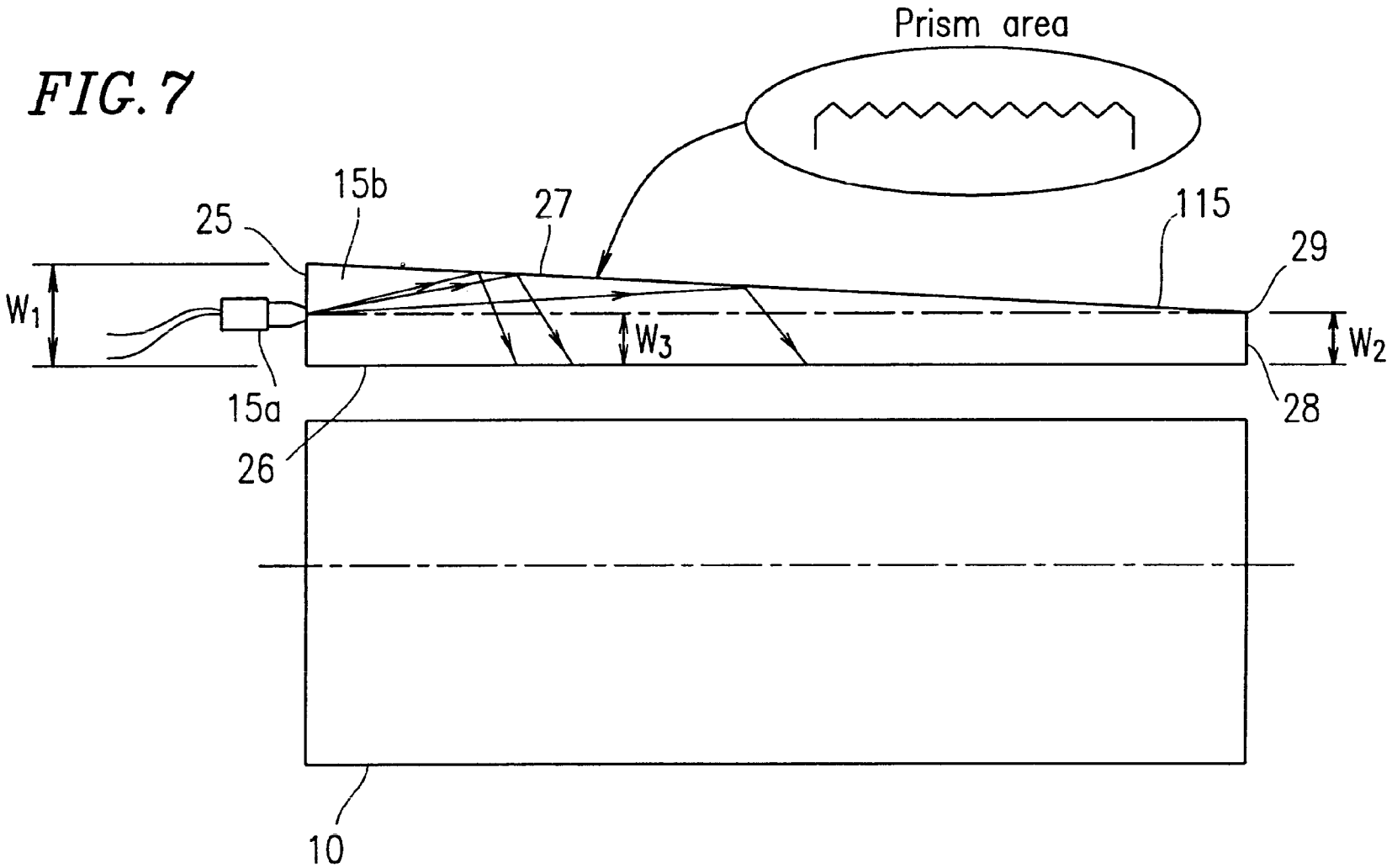
FIG. 7 illustrates a structure of an optical electric charge removal device according to a second example of the present invention.

FIG. 7 shows a structure of an optical electric charge removal device 115 according to a second example of the present invention. In this and the following examples, identical elements previously discussed with respect to FIGS. 1 through 6 bear identical reference numerals and the detailed descriptions thereof will be omitted.

As shown in FIG. 7, the LED lamp 15*a* is provided on the light incident surface 25 so that an optical axis thereof passes through a position 29, which is the intersection of the light reflecting surface 27 and a rear surface 28 of the optical electric charge removal device 115. The optical electric charge removal device 115 has substantially the same structure as that of the optical electric charge removal device 15 except for this point.

Figure 8:
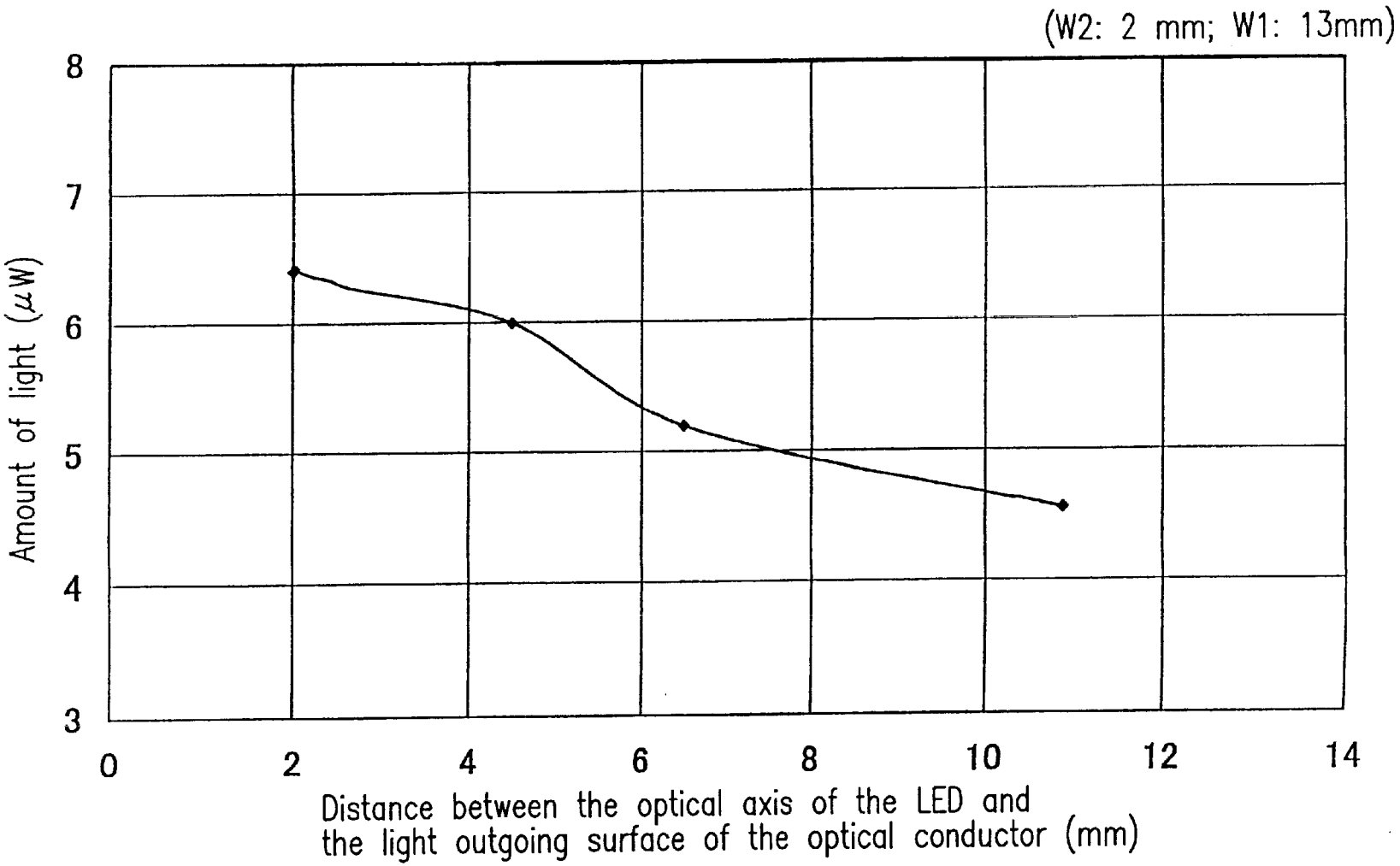
FIG. 8 is a graph illustrating the relationship between the position at which an LED lamp of the optical electric charge removal device is provided and the amount of light exiting the optical electric charge removal device.

FIG. 8 is a graph illustrating the results of an experiment performed by the present inventors to find the relationship between the position at which the LED lamp 15*a* is provided and the amount of light. In this experiment, the change in the amount of light exiting the light outgoing surface 26 (FIG. 7) when the position at which the LED lamp 15*a* is provided, i.e., a distance W3 between the optical axis of the LED lamp 15*a* and the light outgoing surface 26, is changed. The height W1 of the light incident surface 25 is 13 mm, and the height W2 of the light incident surface 28 is 2 mm.

As can be clearly appreciated from FIG. 8, when the LED lamp 15*a* is provided at a height of 2 mm from the light outgoing surface 26 so that the optical axis of the LED lamp 15*a* passes through the position 29 (i.e., the distance W3=the height W2), the amount of light exiting the light outgoing surface 26 is 6 $\mu$W or more, which is necessary to obtain a sufficient light utilization efficiency of the LED lamp 15*a*. The height W2 of 2 mm or more is necessary to restrict the optical conductor 15*b* formed of a resin from warping and thus guarantee the size precision of the optical conductor 15*b*. A structure in which the distance W3 is less than 2 mm is not practical in consideration of restrictions provided by the design of the optical electric charge removal device 15.

Figure 9:
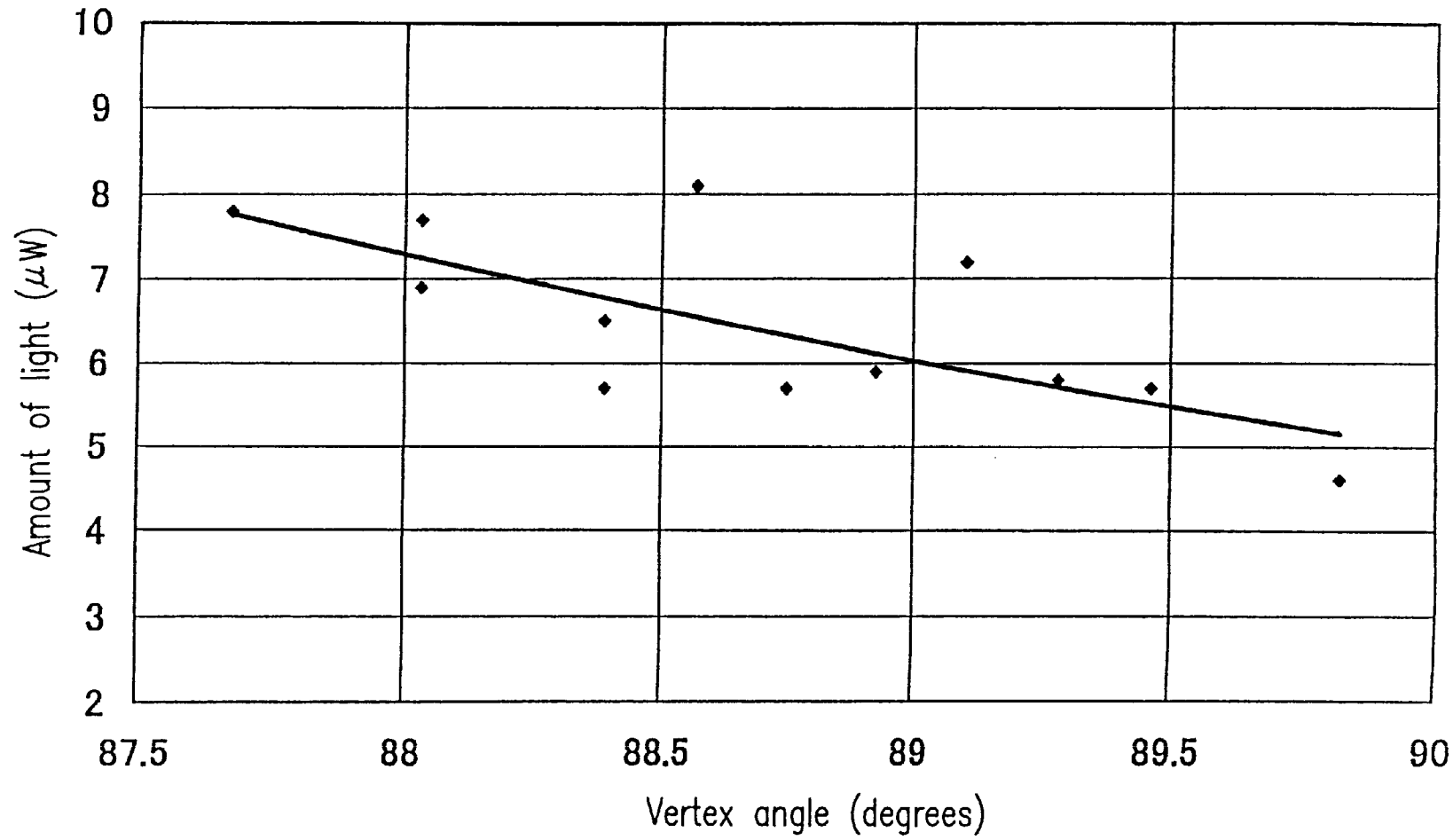
FIG. 9 is a graph illustrating the relationship between the vertex angle θ of an optical conductor of the optical electric charge removal device and the amount of light exiting the optical electric charge removal device.

FIG. 9 is a graph illustrating the results of an experiment performed by the present inventors to find the relationship between the vertex angle θ of the optical conductor 15*b* and the amount of light exiting the light outgoing surface 26. As can be appreciated from FIG. 9, the vertex angle θ of the optical conductor 15*b* is preferably an acute angle of 89 degrees or less in order to guarantee the necessary amount of light of 6 $\mu$W or more. In the description regarding the results of the experiments shown in FIGS. 9 through 13, the identical reference numerals as those in the examples are used for the sake of convenience.

Figure 10:
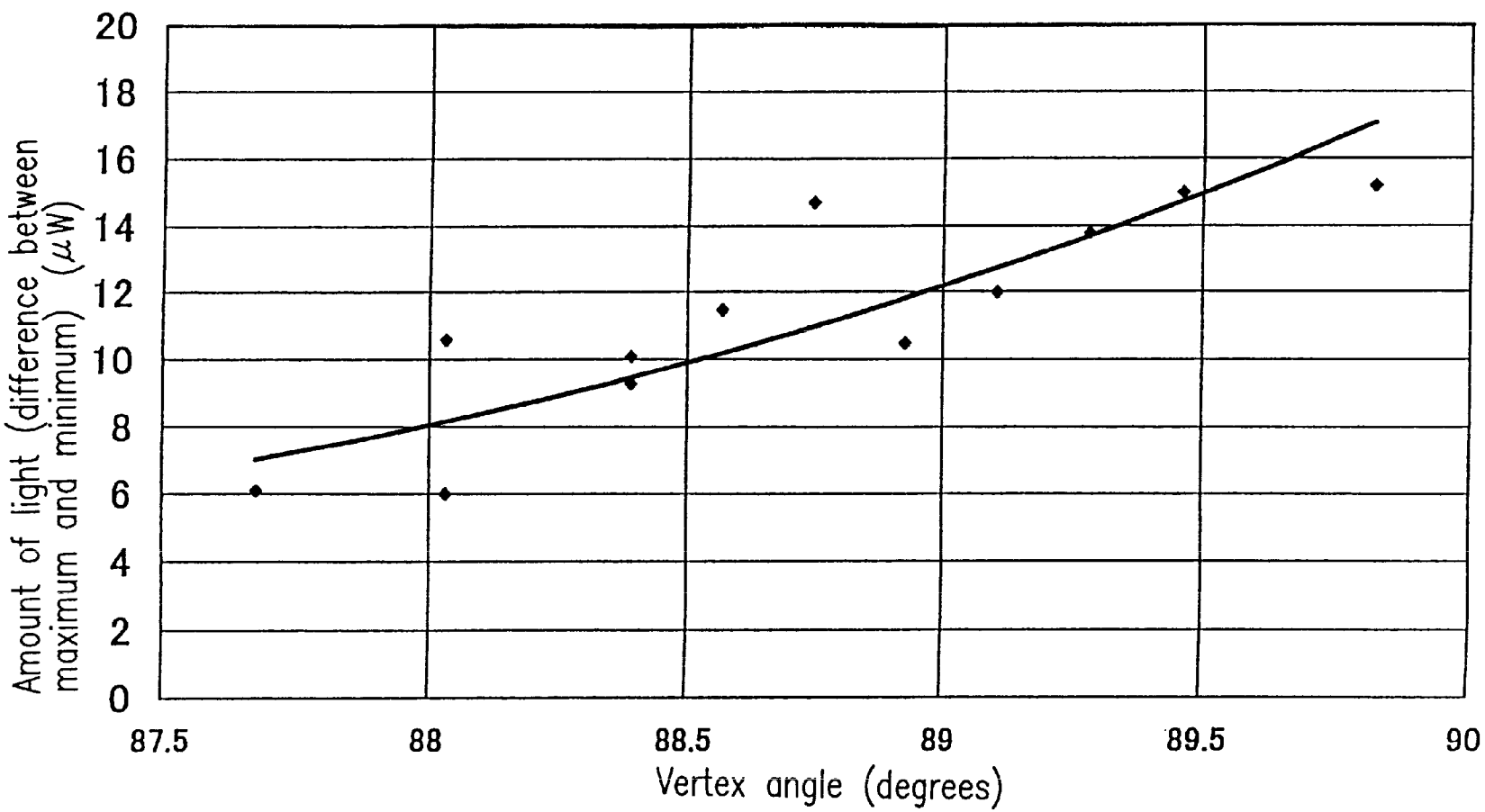
FIG. 10 is a graph illustrating the relationship between the vertex angle θ of the optical conductor and the difference between the maximum amount and the minimum amount of light exiting the optical electric charge removal device.

FIG. 10 is a graph illustrating the results of an experiment performed by the present inventors to find the relationship between the vertex angle θ of the optical conductor 15*b* and the difference between the maximum amount and the minimum amount of light exiting the light outgoing surface 26. As can be appreciated from FIG. 10, the vertex angle θ of the optical conductor 15*b* is preferably an acute angle of 89 degrees or less in order to restrict the difference between the maximum amount and the minimum amount of light within a practical range. As the vertex angle θ decreases, the height W1 of the light incident surface 25 increases, resulting in enlargement of the optical electric charge removal device 115 and also the image formation apparatus 30. The height W1 is preferably 1 mm or more and equal to or less than the outer diameter of the photosensitive drum 10.

Figure 11:
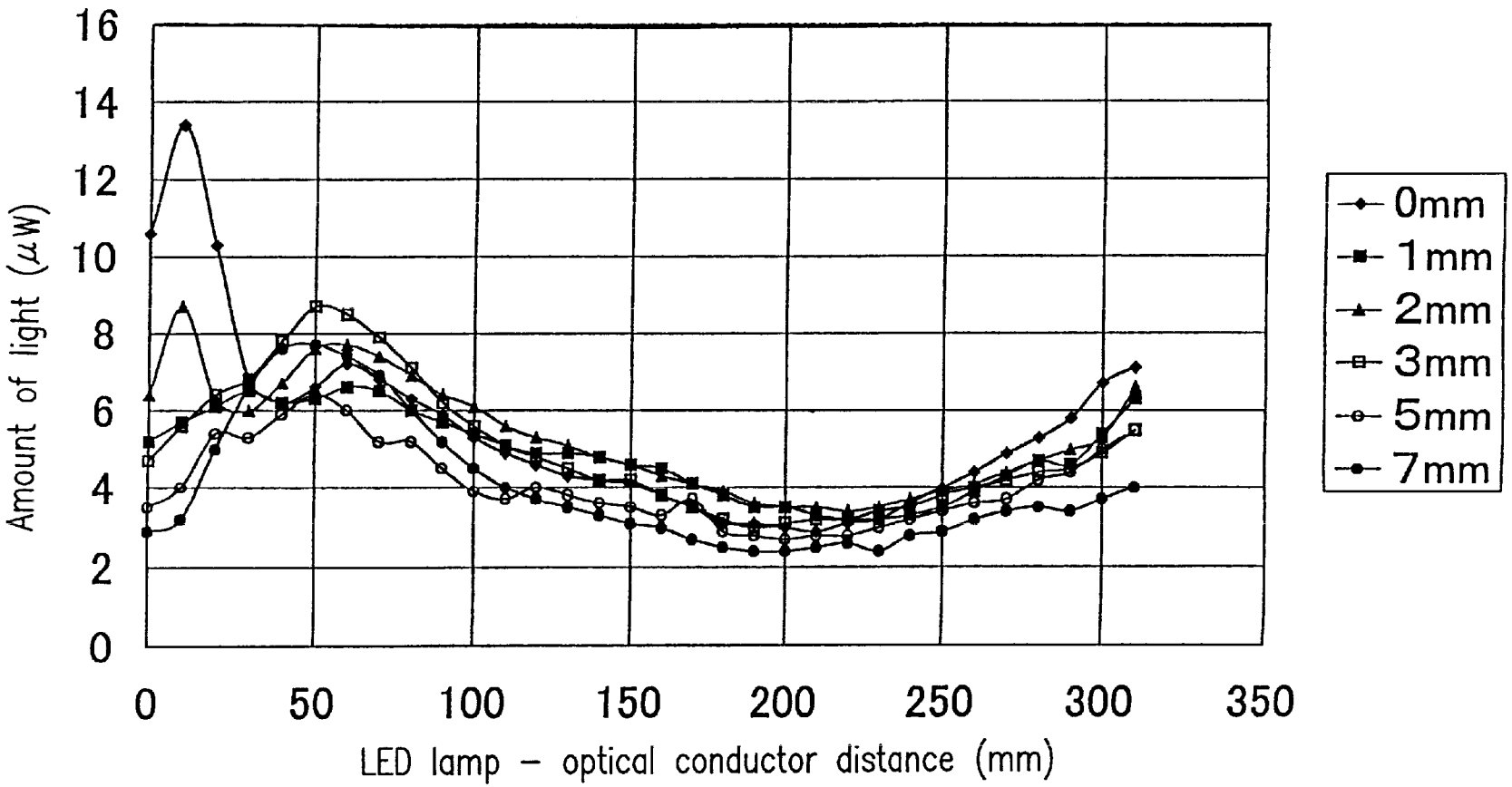
FIG. 11 is a graph illustrating the amount of light exiting the optical electric charge removal device at various measuring positions of the optical conductor at various distances from the LED lamp.

FIG. 11 is a graph illustrating the amount of light exiting the light outgoing surface 26 at various measuring positions of the optical conductor 15*b* at various distances from the LED lamp 15*a*. The curves in FIG. 11 are obtained by varying the distance from the LED lamp 15*a* to the light incident surface 25 to 0 mm, 1 mm, 2 mm, 3 mm, 5 mm and 7 mm. As can be appreciated from FIG. 11, the amount of light tends to be increased as the distance from the LED lamp 15*a* to the measuring point (the LED lamp 15*a*—the optical conductor 15*b* distance) is shorter. In practice, though, it is preferable to provide a certain distance between the LED lamp 15*a* and the optical conductor 15*b*. With a certain distance existing between the LED lamp 15*a* and the optical conductor 15*b*, the optical conductor 15*b* is prevented from having an area where the amount of light is extremely high. Thus, the light amount distribution is relatively uniform in the longitudinal direction of the photosensitive drum 10. In addition, a sudden breakage of the LED lamp 15*a*, which can occur when the process cartridge mounting the optical conductor 15*b* is attached to the image formation apparatus, can be avoided.

Figure 12:
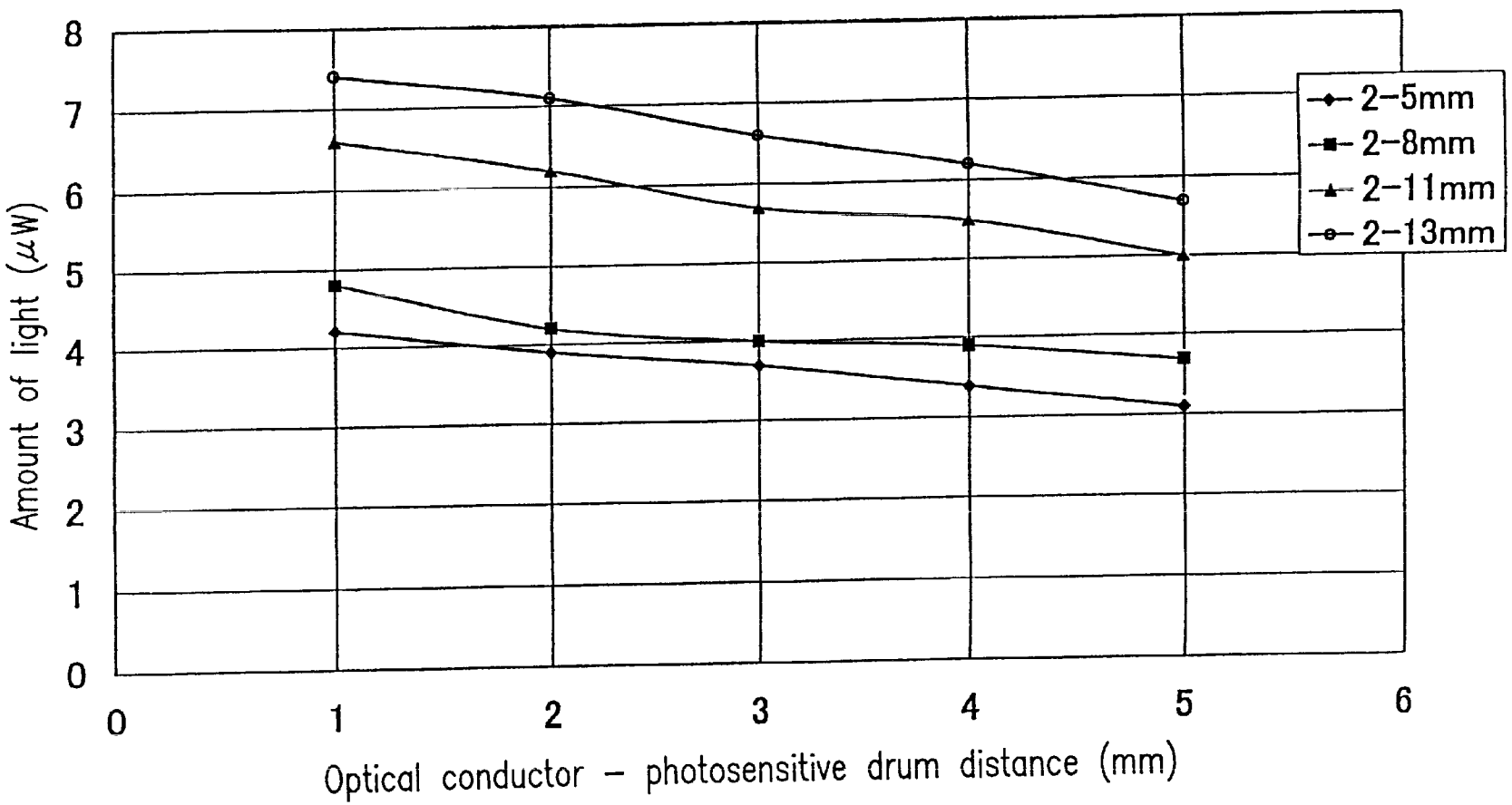
FIG. 12 is a graph illustrating the relationship between the distance from the optical conductor to a photosensitive drum of the image formation apparatus and the amount of light exiting the optical electric charge removal device.

FIG. 12 is a graph illustrating the relationship between the distance from the optical conductor 15*b* to the photosensitive drum 10 and the amount of light exiting the light outgoing surface 26. The curves in FIG. 12 are obtained when the combination of the height W3 of the rear surface 28 (FIG. 6) and the height WI of the light incident surface 25 (FIG. 6) are 2 mm–5 mm, 2 mm–8 mm, 2 mm–11 mm, and 2 mm–13 mm as shown in Table 1. The thickness of the optical conductor 15*b* is fixed at a certain value. As can be appreciated, the height W2 is also fixed to 2 mm.

TABLE 1

| Combination | |
|---|---|
| W1 (light incident surface) | W2 (rear surface) |
| 5 mm | 2 mm |
| 8 mm | 2 mm |
| 11 mm | 2 mm |
| 13 mm | 2 mm |

As can be appreciated from FIG. 12, as the distance from the optical conductor 15*b* to the photosensitive drum 10 is shorter, the amount of light is larger, regardless of the shape of the optical conductor 15*b*. Depending on the shape of the optical conductor 15*b*, the necessary amount of light of 6 $\mu$W or more is guaranteed by setting the distance from the optical conductor 15*b* to the photosensitive drum 10 at 2 mm or less. It is not practical, though, to set the distance from the optical conductor 15*b* to the photosensitive drum 10 at less than 1 mm, in consideration of the size precision of the various elements of the optical electric charge removal device 115. In addition, when the optical conductor 15*b* and the photosensitive drum 10 are so close to each other, the photosensitive drum 10 may possibly be broken when the process cartridge mounting the optical conductor 15*b* is slid to be attached to the image formation apparatus 30.

Figure 13:
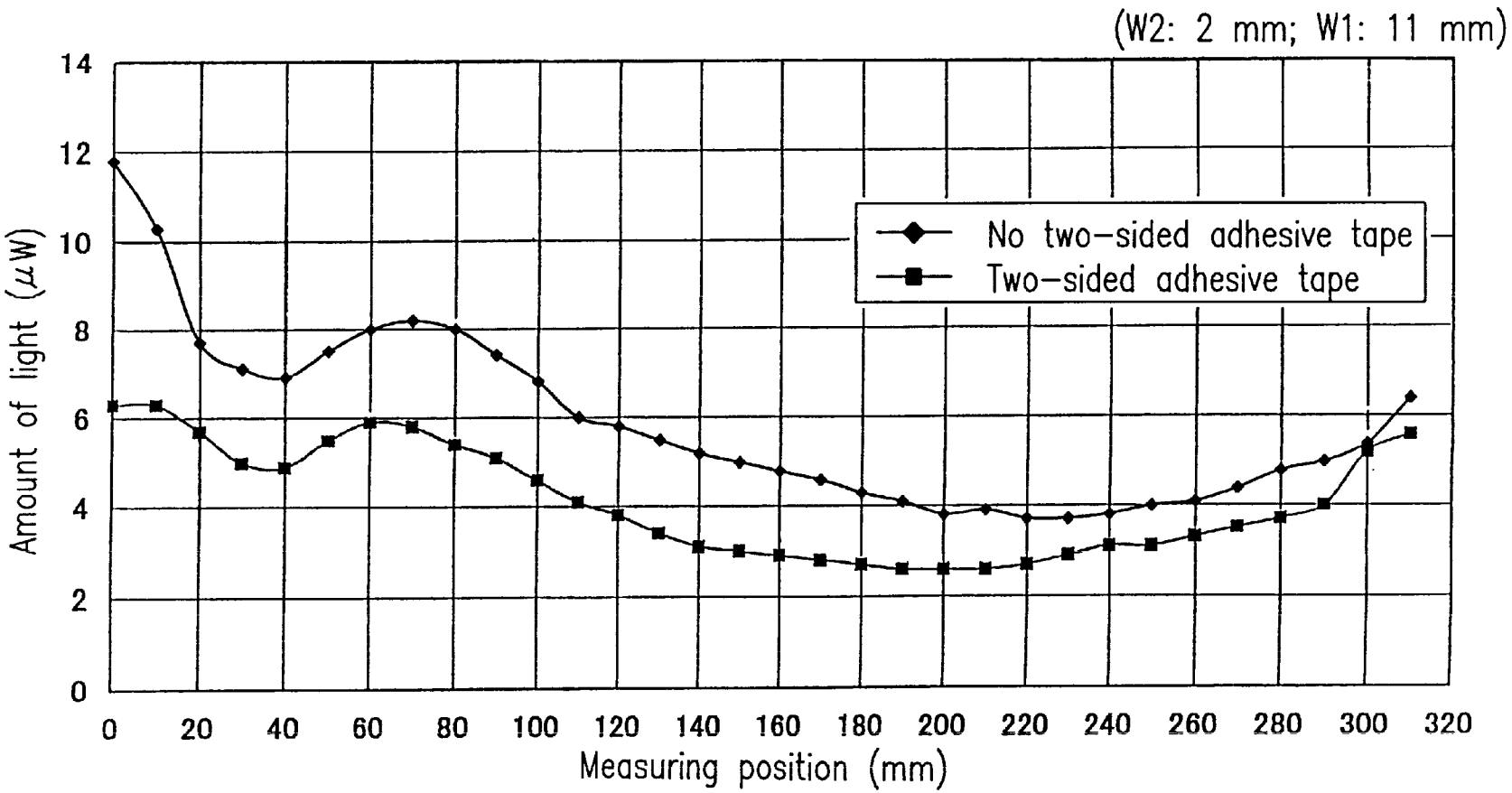
FIG. 13 is a graph illustrating the relationship between the amount of light exiting the optical electric charge removal device at various measuring positions of the optical conductor at various distances from the LED lamp, when a two-sided adhesive tape is provided on a light reflecting surface of the optical conductor.

FIG. 13 is a graph illustrating the relationship between the amount of light exiting the light outgoing surface 26 at various measuring positions of the optical conductor 15*b* at various distances from the LED lamp 15*a*, when a two-sided (whitened) adhesive tape is provided on the light reflecting surface 27 of the optical conductor 15*b*. As can be appreciated from FIG. 13, when the two-sided adhesive tape is provided, the light amount is prevented from becoming extremely high in an area of the optical conductor 15*b* which is relatively close to the LED lamp 15*a*. Thus, non-uniformity in the entire distribution of light is suppressed, as compared to the case where the two-sides adhesive tape is not provided.

EXAMPLE 3

Figure 14:
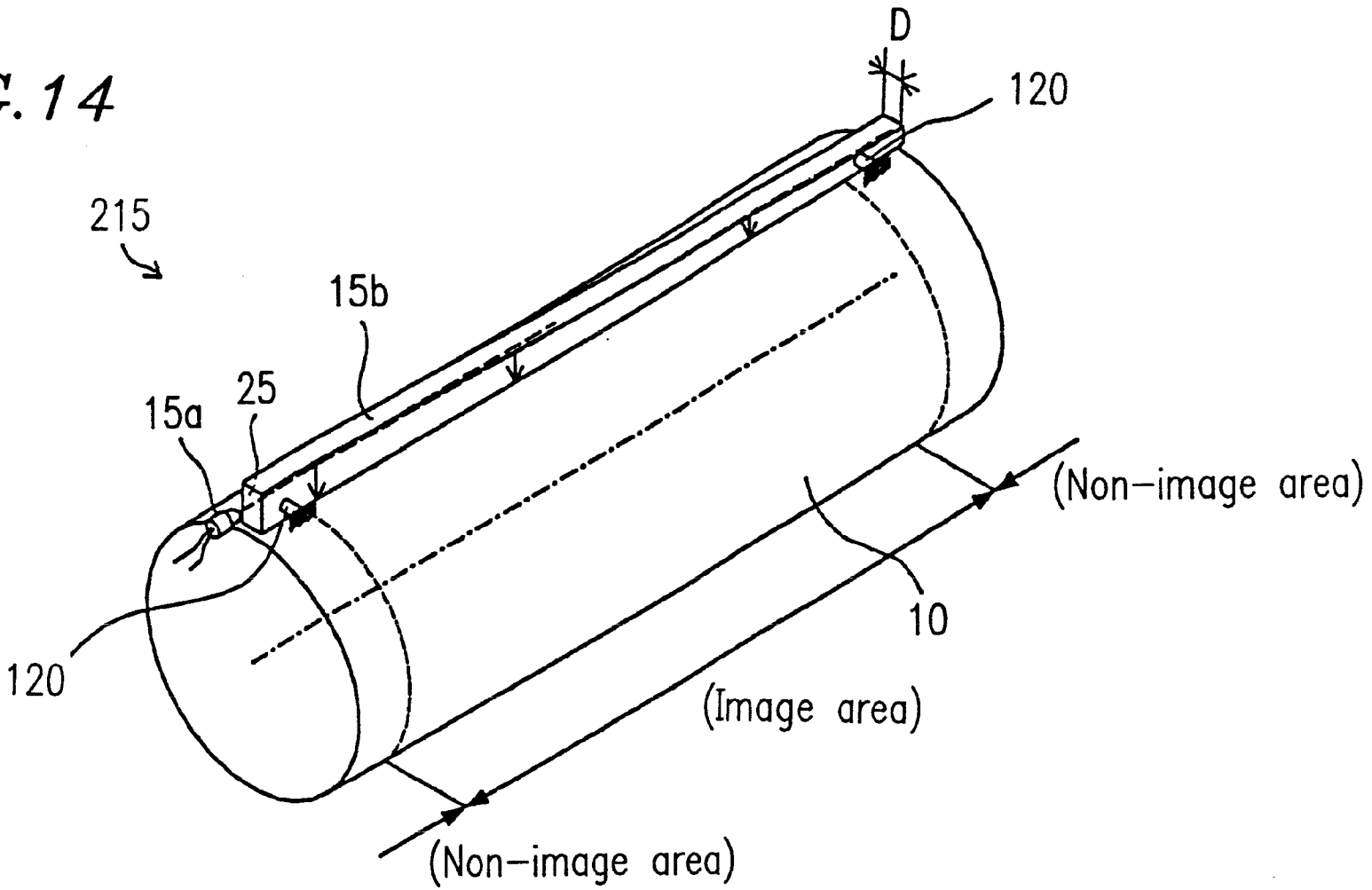
FIG. 14 is a perspective view of an optical electric charge removal device according to a third example of the present invention.
Figure 15:
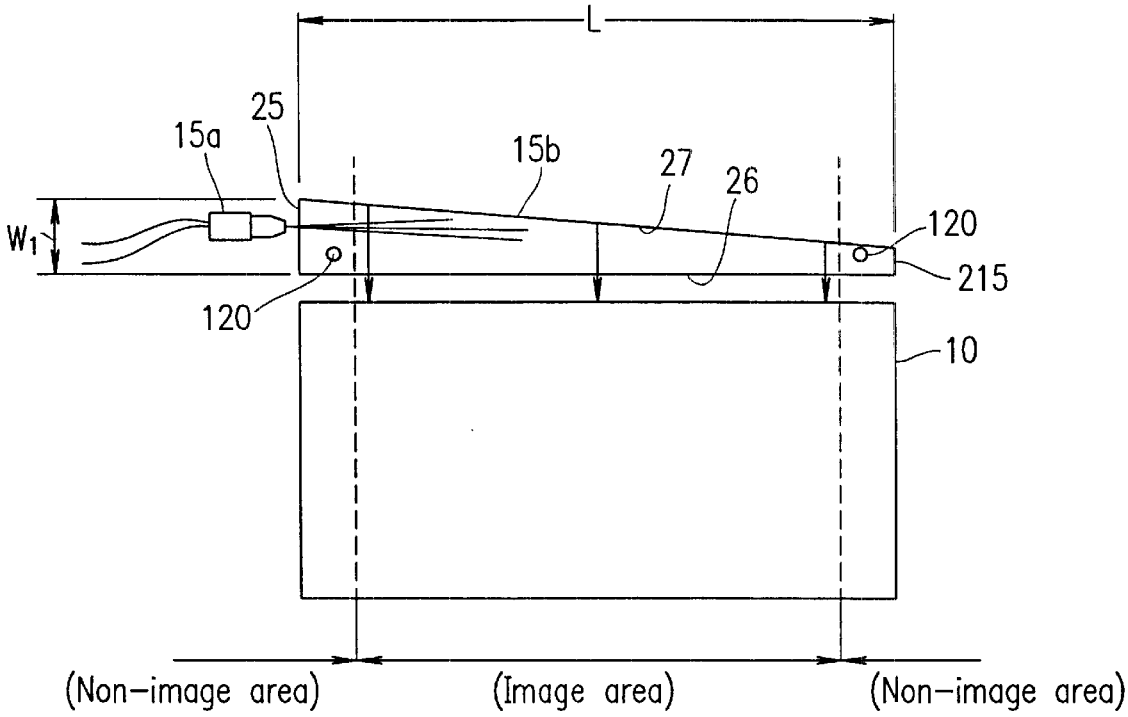
FIG. 15 is a front view of the optical electric charge removal device shown in FIG. 14.

FIG. 14 is a perspective view of an optical electric charge removal device 215 according to a third example of the present invention, and FIG. 15 is a front view of the optical electric charge removal device 215.

As shown in FIGS. 14 and 15, the optical conductor 15*b* included in the electric charge removal device 215 is supported by support members 120 so that the optical conductor 15*b* floats (with no contact) with respect to the elements in the image forming section 47 (FIG. 1) and only contacts the LED lamp 15*a* at the light incident surface 25. The support members 120 are formed of an acrylic resin or the like, and support the optical conductor 15*b* in areas thereof facing the non-image areas of the photosensitive drum 10. The non-image areas are provided outside of the image area.

Figure 22A:
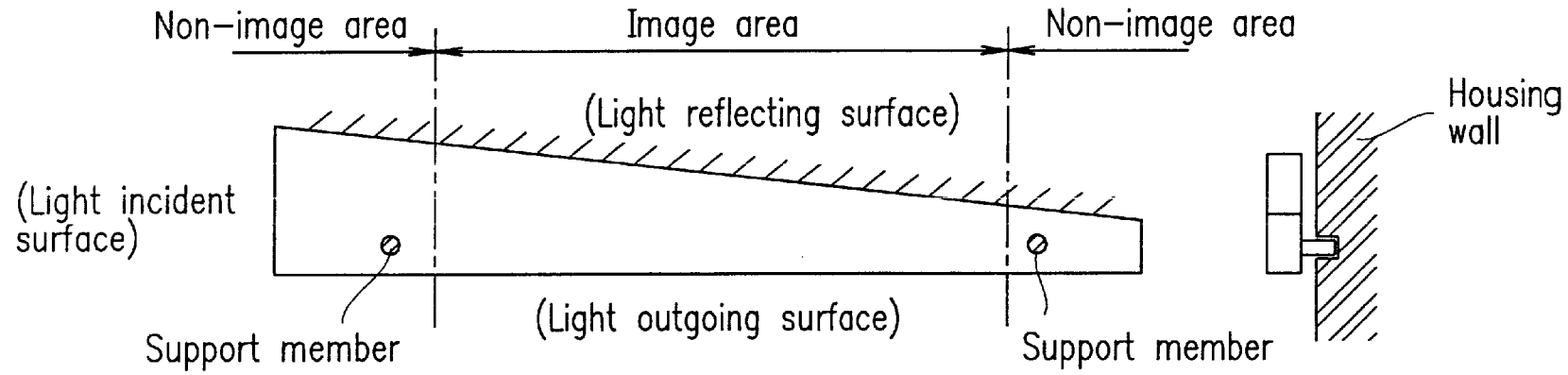
FIGS. 22A, 22B and 23 illustrate a method for providing support members for an optical conductor.
Figure 22B:
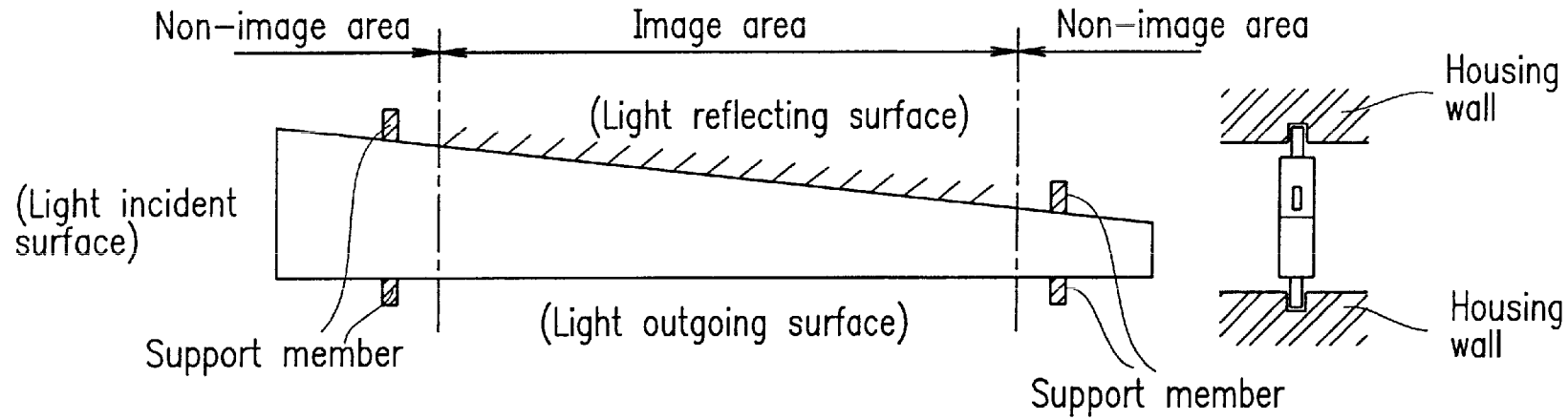
Figure 23:
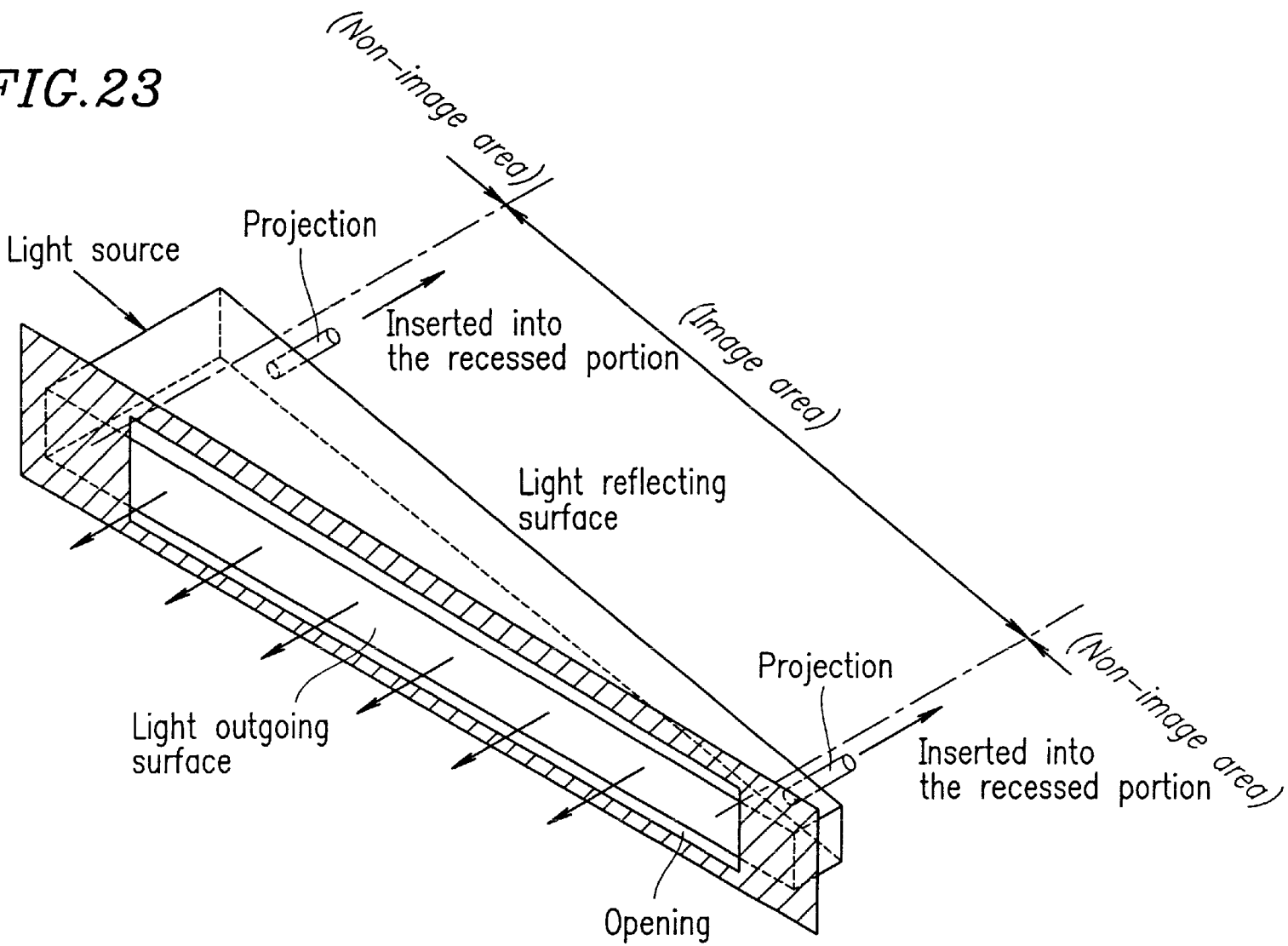

The support members 120 can be attached to the optical conductor 15*b* by, for example, the following two methods. One method is shown in FIGS. 22A, 22B and 23. While the optical conductor 15*b* is formed of a resin, cylindrical boss-like or rib-like projections are formed at appropriate positions in areas of the optical conductor 15*b* which will face the non-image areas of the photosensitive drum 10. In order to stably support the optical conductor 15*b*, it is preferable to provide at least one projection at each of two ends of the optical conductor 15*b*. The projections are received in recessed portions of a wall of a housing or a casing of the process cartridge 20 or the like for accommodating the optical conductor 15*b*. Thus, the optical conductor 15*b* can be supported by the support members 120.

Figure 24A:
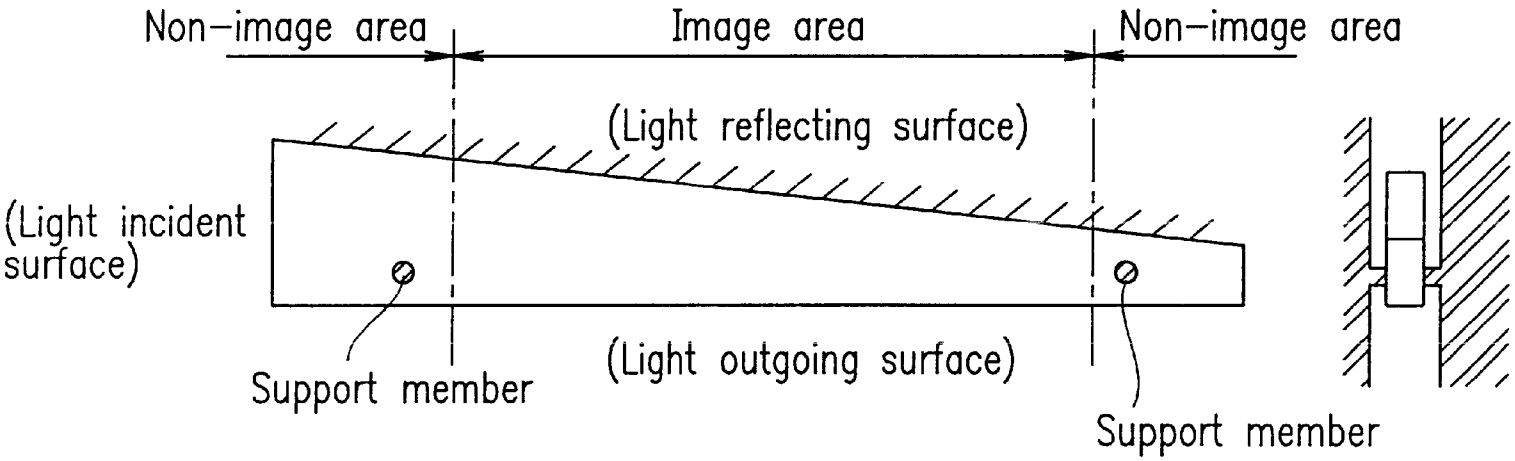
FIGS. 24A and 24B illustrate another method for providing support members for an optical conductor.
Figure 24B:
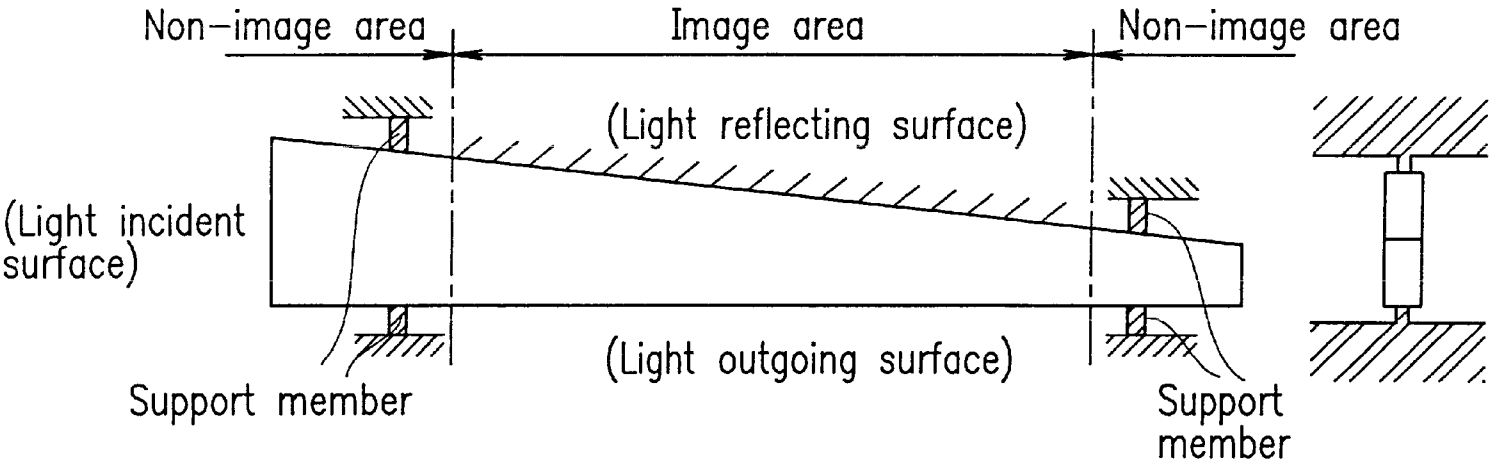
Figure 25:
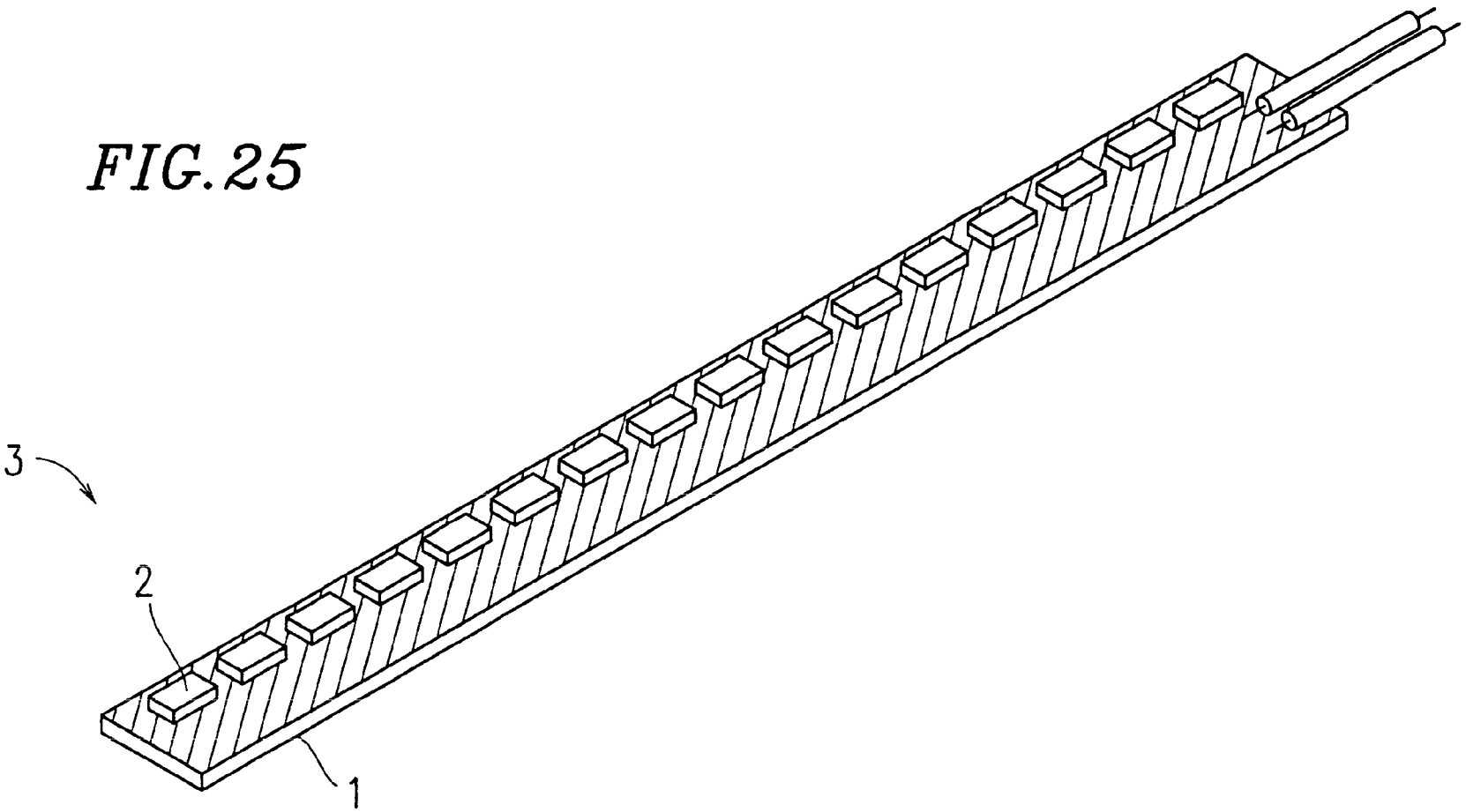
FIG. 25 illustrates a structure of an LED array usable in a conventional optical electric charge removal device.

One other method is shown in FIGS. 24A and 24B. Cylindrical boss-like or rib-like projections are integrally formed on a wall of a housing or a casing for accommodating the optical conductor 15*b*, so as to face each other with a prescribed distance therebetween. The optical conductor 15*b* is interposed between the tips of the projections.

The optical electric charge removal device 215 according to the third example has the following advantages. Since the LED lamp 15*a* is in contact with the light incident surface 25, the light from the LED lamp 15*a* can be incident on the optical conductor 15*b* efficiently. Since the optical conductor 15*b* is out of contact with the elements in the image forming section 47 (FIG. 1), the incident light can be guided to the photosensitive drum 10 through the light outgoing face 26 of the optical conductor 15*b* without the optical path being blocked. Since the optical conductor 15*b* is separate from the LED lamp 15*a* and the support members 120 are provided in the areas facing the non-image areas of the photosensitive drum 10 (outside the image area), the optical conductor 15*b* can be detached without detaching the LED lamp 15*a*. Therefore, electricity-related troubles such as defective connections or the like are unlikely to occur, and the influence of the LED lamp 15*a* on the optical path can be minimized. The light from the LED lamp 15*a* does not reach the non-image areas of the photosensitive drum 10, and therefore, even when the residual charges on the photosensitive drum 10 are not completely removed, no inconvenience occurs in image formation. As a result, the reliability of the optical electric charge removal device 215 is improved.

Figure 16:
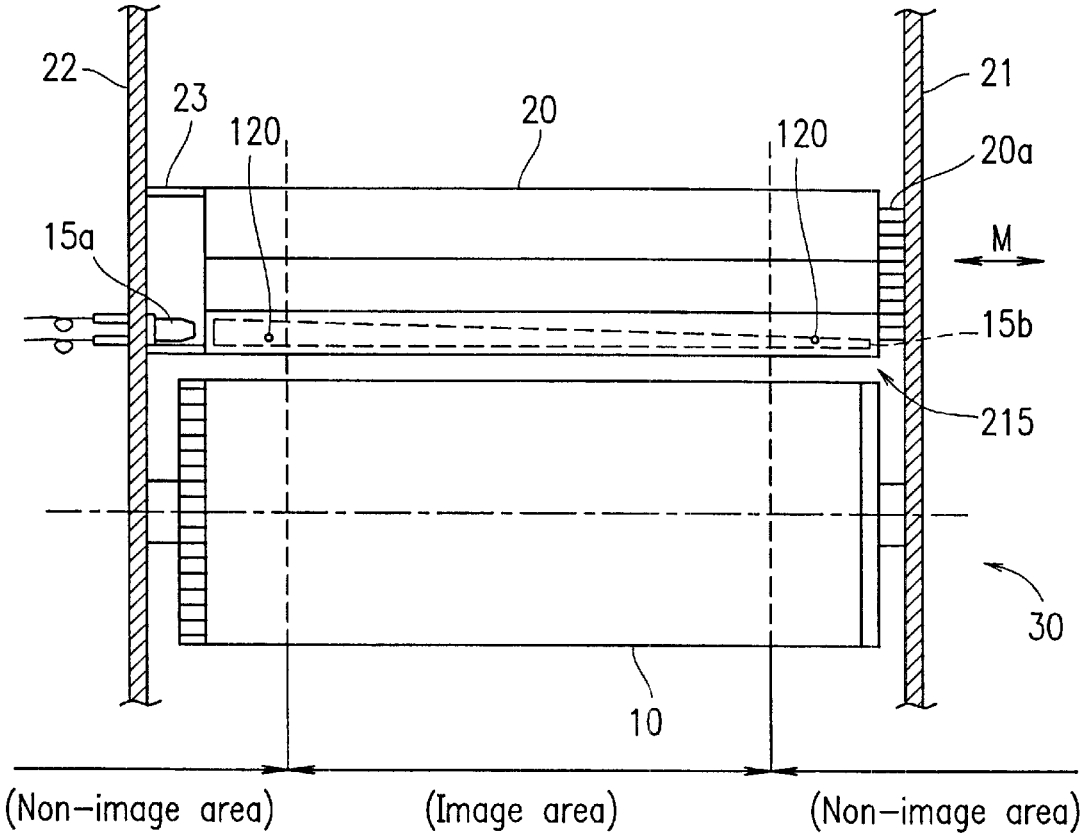
FIG. 16 illustrates another embodiment of the optical electric charge removal device according to the third example of the present invention.

FIG. 16 illustrates the optical conductor 15*b* mounted on the process cartridge 20 via the support members 120. In this case, the support members 120 are provided in areas in the process cartridge 20 facing the non-image areas outside the image area of the photosensitive drum 10. The process cartridge 20 is slidable along the cartridge guides 23 in directions represented by arrows M in FIG. 16 by operating a handle 21*a* so as to attached to or detached from the image formation apparatus 30. The cartridge guides 23 extend between the rear frame 22 and the front frame 21 of the image formation apparatus 30. The LED lamp 15*a* is secured to the rear frame 22, and electric lines connected to the LED lamp 15*a* are connected to an external device behind the rear frame 22.

In the case where the optical electric charge removal device 215 is mounted on the detachable process cartridge 20, the operability of the optical electric charge removal device 215 can be further improved.

The optical conductor 15*b* may be detachable from the process cartridge 20. In this case, the optical conductor 15*b* can be detached from the process cartridge 20 for maintenance. This further improves the reliability and the operability of the optical electric charge removal device 215.

EXAMPLE 4

Figure 17:
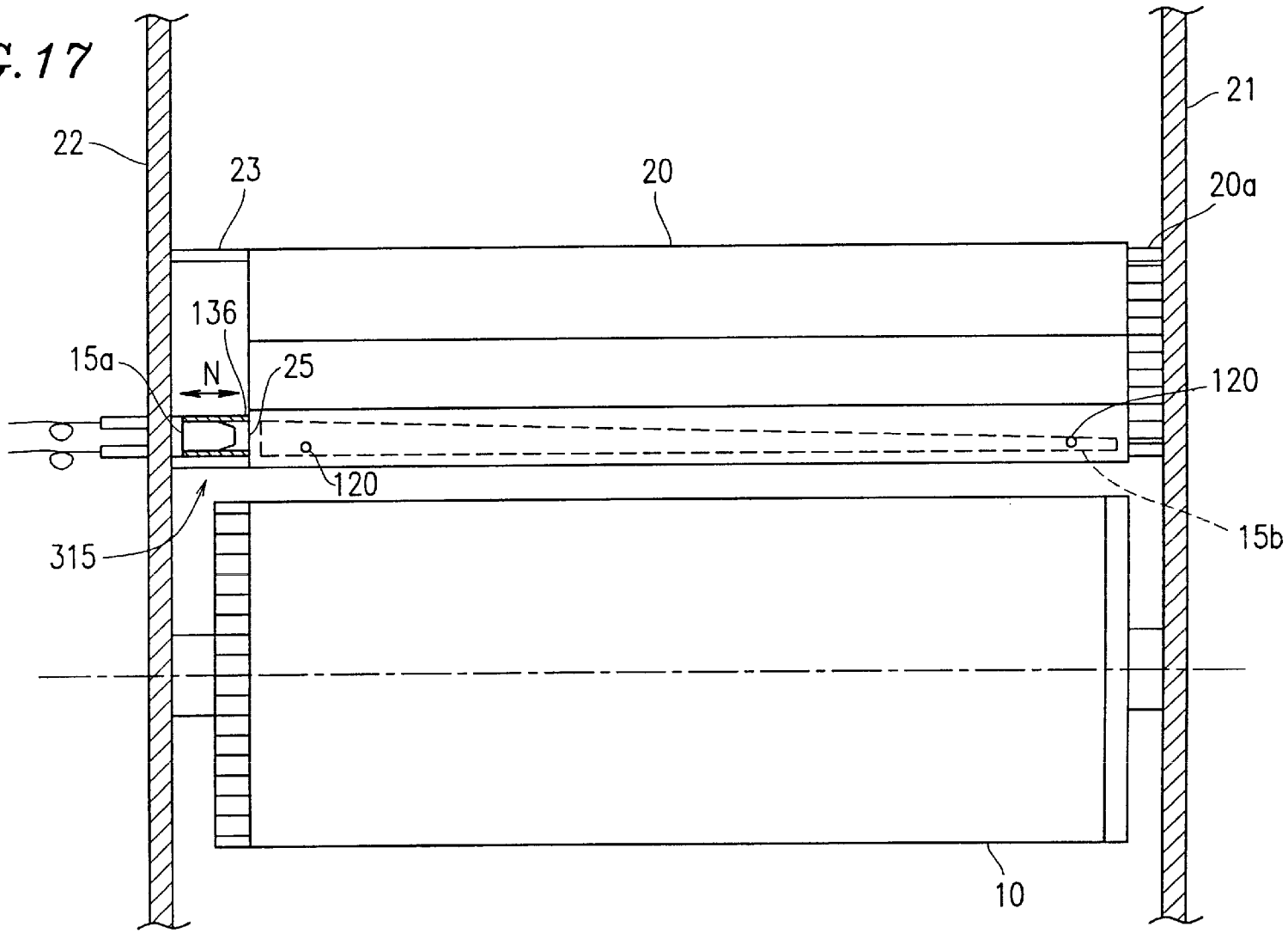
FIG. 17 illustrates a structure of an optical electric charge removal device according to a fourth example of the present invention.
Figure 18A:
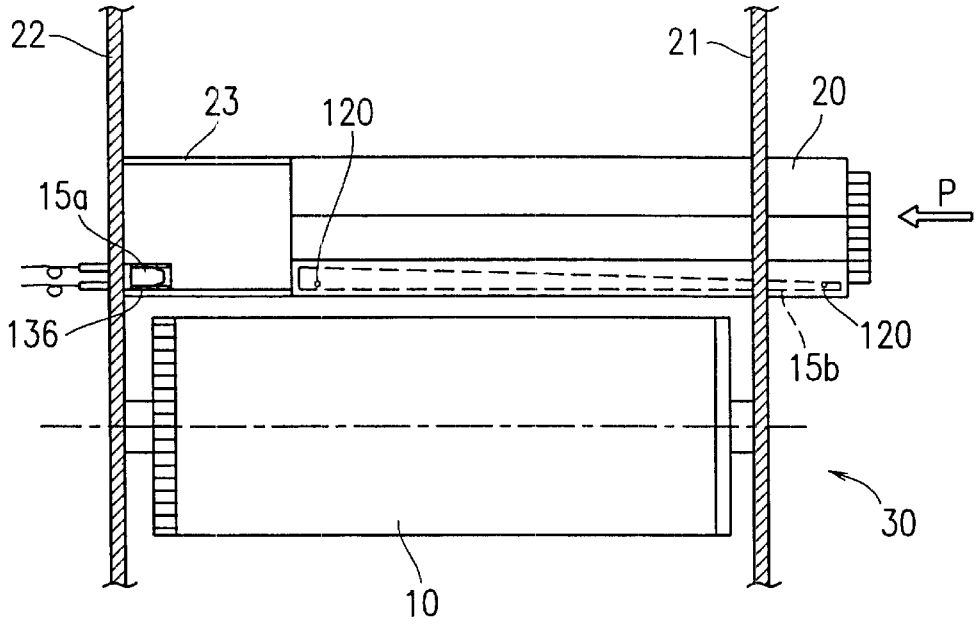
FIGS. 18A and 18B illustrate an attachment and detachment of a process cartridge accommodating the optical electric charge removal device shown in FIG. 17 to and from image formation apparatus.
Figure 18B:
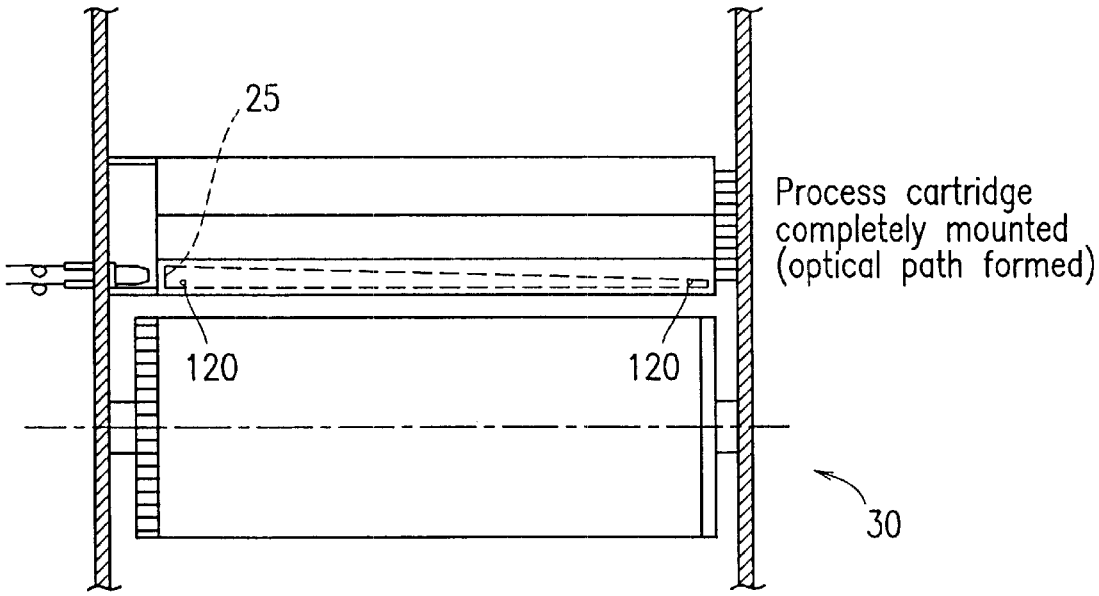

FIG. 17 shows a structure of an optical electric charge removal device 315 according to a fourth example of the present invention. FIGS. 18A and 18B illustrate an attachment and detachment of the process cartridge 20 mounting the optical electric charge removal device 315 to and from the image formation apparatus 30.

The optical electric charge removal device 315 includes a light blocking member 136 provided so as to cover the LED lamp 15*a* in addition to the elements of the optical electric charge removal device 215 described in the third example. The light blocking member 136 is formed of a flexible and elastic material such as sponge or the like. The light blocking member 136 prevents the light emitted by the LED lamp 15*a* from leaking to the outside of the optical conductor 15*b*. The materials of the light blocking member 136 may be light-absorbing or light-reflective, but is preferably light-reflective in consideration of the light utilization efficiency. The light blocking member 136 is provided at such a position that a surface thereof facing the optical conductor 15*b* is sufficiently close to contact the light incident surface 25 of the optical conductor 15*b*. The light blocking member 136 expands or shrinks in directions represented by arrows N in accordance with the positional error of attachment of the optical conductor 15*b* to the process cartridge 20. Accordingly, in the case where the process cartridge 20 once detached from the image formation apparatus 30 as shown in FIG. 18A is again inserted into the image formation apparatus 30 in a direction shown in arrow P in FIG. 18A into a state shown in FIG. 18B, the light blocking member 136 expands or shrinks in accordance with the position of the light incident surface 25 of the optical conductor 15*b*. Therefore, the light emitted by the LED lamp 15*a* is always guided to the light incident surface 25 with no waste.

As described above, the optical electric charge removal device 315 according to the fourth example includes the light blocking member 136 covering the LED lamp 15*a*. Due to such a structure, the light emitted by the LED lamp 15*a* can always be guided to the optical incident surface 25 of the optical conductor 15*b* efficiently without being scattered. The light blocking member 136 is flexible and elastic. Therefore, even in a structure shown in FIG. 17 where the LED lamp 15*a* is provided in the main body of the image formation apparatus 30 and the optical conductor 15*b* is separately mounted on the detachable process cartridge 20, an optical path can be formed with certainty so as to guide the light emitted by the LED lamp 15*a*to the light incident surface 25 of the optical conductor 15*b*. The adverse influences, caused by the LED lamp 15*a* and the optical conductor 15*b* being separately provided, on the assembly precision of the image formation apparatus 30 and the process cartridge 20, and the positioning precision of attachment of the process cartridge 20 to the image formation apparatus 30, are eliminated.

EXAMPLE 5

Figure 19:
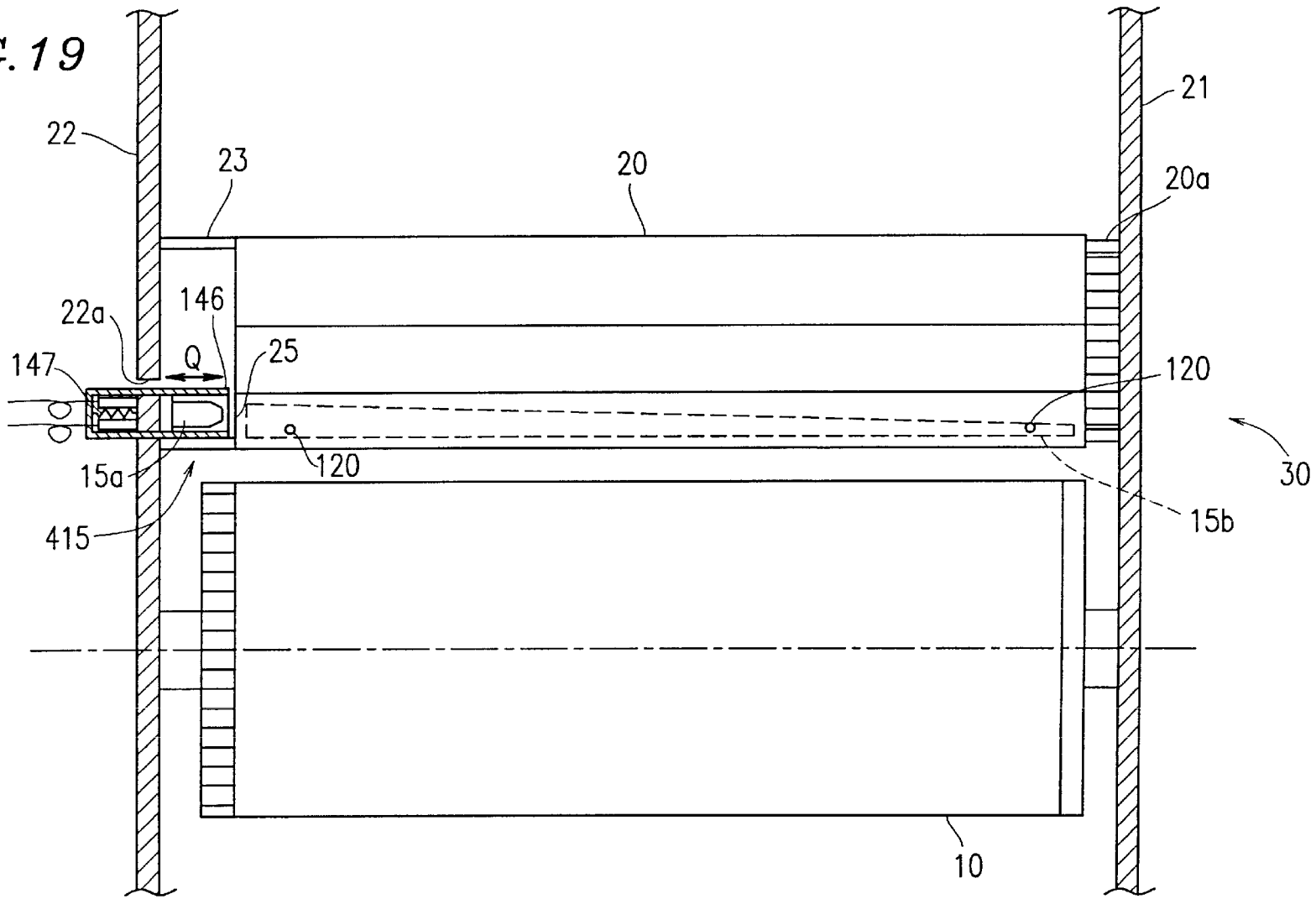
FIG. 19 illustrates a structure of an optical electric charge removal device according to a fifth example of the present invention.

FIG. 19 illustrates a structure of an optical electric charge removal device 415 according to a fifth example of the present invention.

The optical electric charge removal device 415 includes a light blocking member 146 provided so as to cover the LED lamp 15*a* and a spring 147 attached to the light blocking member 146, in addition to the elements of the optical electric charge removal device 215 described in the third example.

Unlike the light blocking member 136 described in the fourth example, the light blocking member 146 is formed of a relative hard material such as a polycarbonate or the like, and covers the LED lamp 15*a* from behind the rear frame 22 of the image formation apparatus 30. The rear frame 22 has holes 22*a* through which the light blocking member 146 passes. The spring 147 is a compression spring connected between a surface of the light blocking member 146 opposite the surface facing the optical conductor 15*b* and the rear frame 22. Due to the urging force of the spring 147, the light blocking member 146 is movable closer to or farther from the light incident surface 25 of the light incident surface 25 in directions shown by arrows Q in accordance with the positional error of attachment of the optical conductor 15*b* to be pressed on the light incident surface 25. Therefore, the light emitted by the LED lamp 15*a* is prevented from leaking from the optical conductor 15*b*.

As described above, the optical electric charge removal device 415 according to the fifth example includes the light blocking member 146 covering the LED lamp 15*a*. Due to such a structure, the light emitted by the LED lamp 15*a* can always be guided to the optical incident surface 25 of the optical conductor 15*b* efficiently without being scattered. The light blocking member 146 is movable closer to or farther from the light incident surface 25 of the optical conductor 15*b*. Therefore, even in a structure shown in FIG. 19 where the LED lamp 15*a* is provided in the main body of the image formation apparatus 30 and the optical conductor 15*b* is separately mounted on the detachable process cartridge 20, an optical path can be formed with certainty so as to guide the light emitted by the LED lamp 15*a* to the light incident surface 25 of the optical conductor 15*b*. The adverse influences, caused by the LED lamp 15*a* and the optical conductor 15*b* being separately provided, on the assembly precision of the image formation apparatus 30 and the process cartridge 20, and the positioning precision of attachment of the process cartridge 20 to the image formation apparatus 30, are eliminated.

EXAMPLE 6

Figure 20:
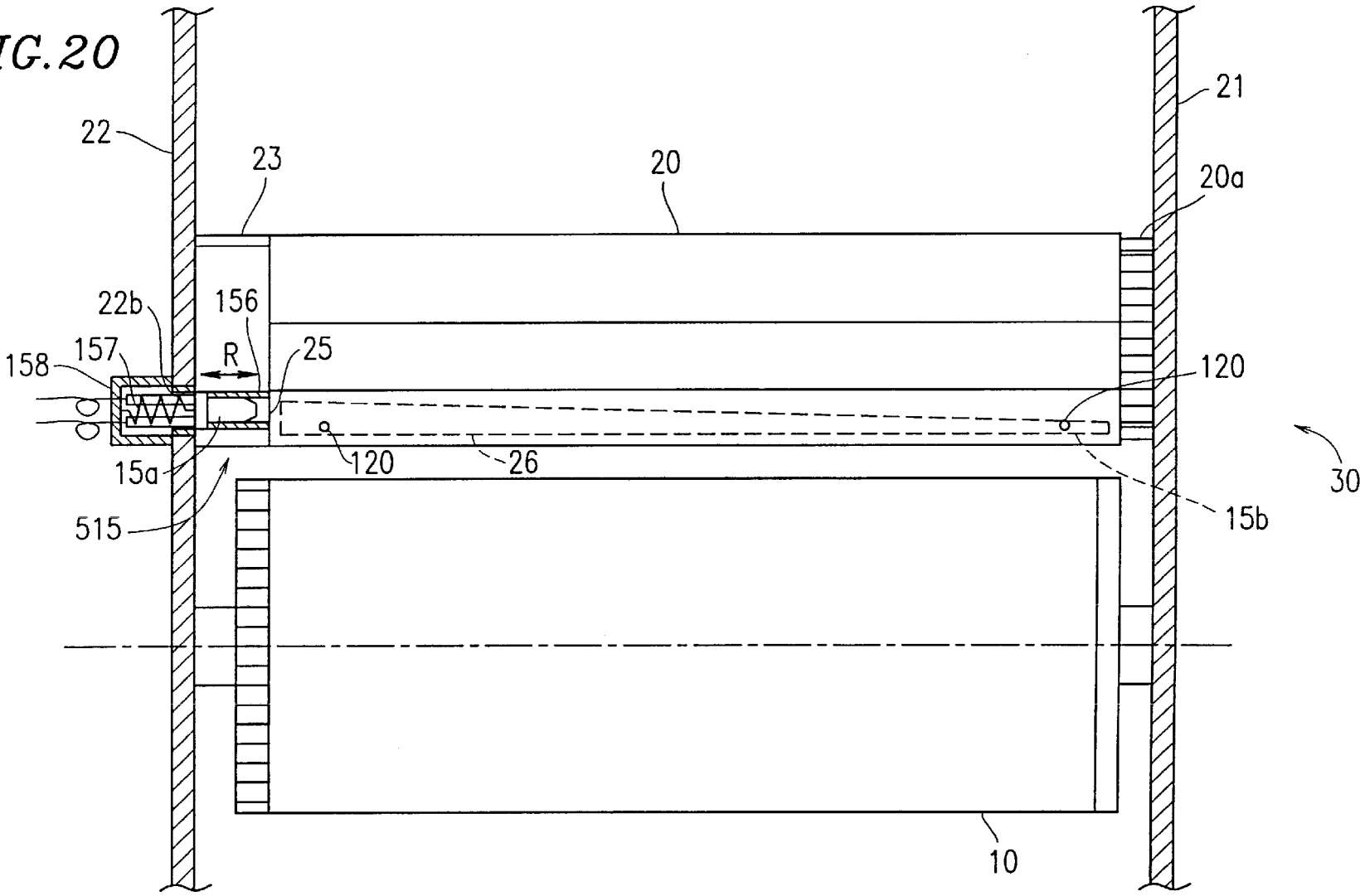
FIG. 20 illustrates a structure of an optical electric charge removal device according to a sixth example of the present invention.
Figure 21A:
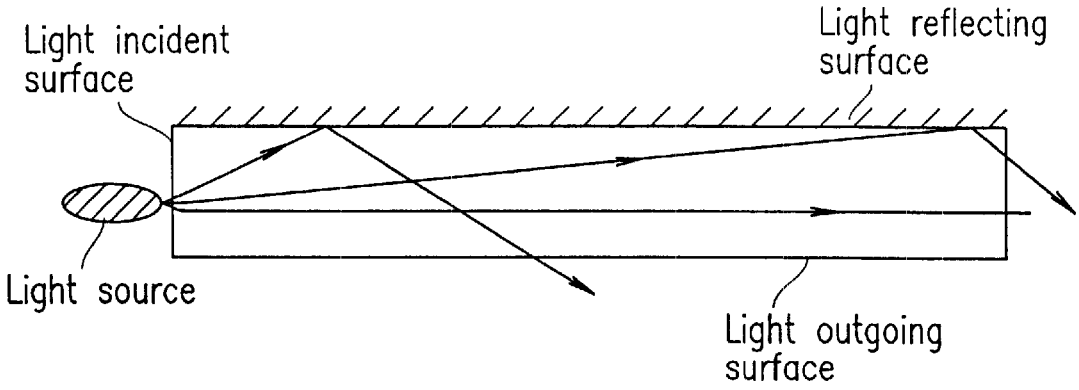
FIGS. 21A and 21B illustrate a preferable shape of an optical electric charge removal device.
Figure 21B:
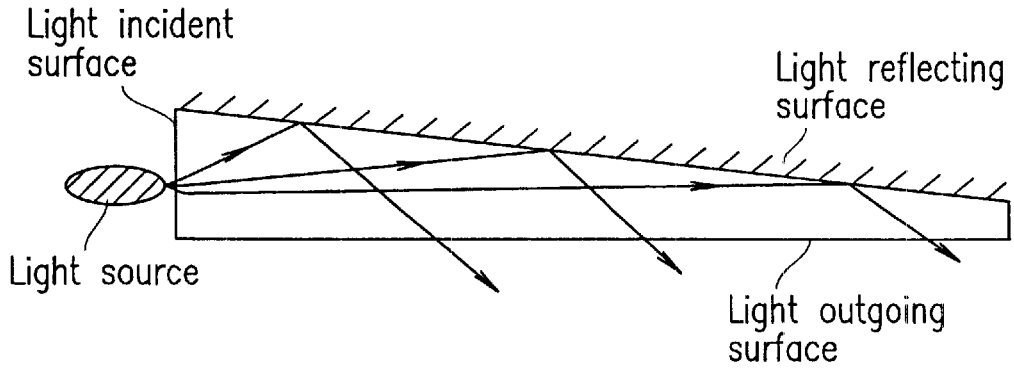

FIG. 20 illustrates a structure of an optical electric charge removal device 515 according to a sixth example of the present invention.

The optical electric charge removal device 515 includes a light blocking member 156 provided so as to cover the LED lamp 15*a*, a cover 158 in an area of the rear frame 22 of the image formation apparatus 30 corresponding to the LED lamp 15*a*, and a spring 157 provided between the cover 158 and the LED lamp 15*a*, in addition to the elements of the optical electric charge removal device 215 described in the third example.

Unlike the light blocking member 136 described in the fourth example, the light blocking member 156 is formed of a relatively hard material, and covers a side surface of the LED lamp 15*a* which is substantially on the same level with the light outgoing surface 26 of the optical conductor 15*b*. The LED lamp 15*a* and the light blocking member 156 are integrated together. The spring 157 is a compression spring having one end secured to the cover 158, and urges the lamp 15*a* and the light blocking member 156 toward the optical conductor 15*b*. The rear frame 22 has a hole 22*b* through which the LED lamp 15*a* and the light blocking member 156 pass. Due to the urging force of the spring 157, the light blocking member 156 is movable closer to or farther from the light incident surface 25 of the light conductor 15*b* in directions shown by arrows R in accordance with the positional error of attachment of the optical conductor 15*b* to be pressed on the light incident surface 25. Therefore, the light emitted by the LED lamp 15*a* is prevented from leaking to the outside of the optical conductor 15*b*.

As described above, the optical electric charge removal device 515 according to the sixth example includes the light blocking member 156 covering the LED lamp 15*a*. Due to such a structure, the light emitted by the LED lamp 15*a* can always be guided to the optical incident surface 25 of the optical conductor 15*b* efficiently without being scattered. The integrated assembly of the LED lamp 15*a* and the light blocking member 156 is movable closer to or farther from the light incident surface 25 of the optical conductor 15*b* by the urging force of the spring 157. Therefore, even in a structure shown in FIG. 20 where the LED lamp 15*a* is provided in the main body of the image formation apparatus 30 and the optical conductor 15*b* is separately mounted on the detachable process cartridge 20, an optical path can be formed with certainty so as to guide the light emitted by the LED lamp 15*a* to the light incident surface 25 of the optical conductor 15*b*. The adverse influences, caused by the LED lamp 15*a* and the optical conductor 15*b* being separately provided, on the assembly precision of the image formation apparatus 30 and the process cartridge 20, and the positioning precision of attachment of the process cartridge 20 to the image formation apparatus 30, are eliminated.

According to the present invention, the point light source can be used for its full life and thus is not wastefully discarded. Therefore, this reduces the production costs of the components are reduced and, further, malfunction of the optical electric charge removal device caused by electricity-related troubles such as defective connection of electric circuits are unlikely to occur. The optical conductor contaminated with toner or the like can be detached from the image formation apparatus while being accommodated in the process cartridge. Therefore, the optical conductor can be cleaned by not just a specialized maintenance personnel. Although the optical conductor is not exhausted, the optical conductor is detached while accommodated in the process cartridge when, for example, the life of the developer is expired, and is replaced with a new optical conductor not contaminated with toner or the like. As compared to the case where the optical conductor is secured in the image formation apparatus, the reduction in electric charge removal ability due to contamination of the optical conductor is minimized. Therefore, the residual charges on the photosensitive member are removed with certainty so as to always perform high quality image formation.

In one embodiment of the invention, the point light source is unlikely to be contaminated with toner, and thus the electric charge removal efficiency is prevented from decreasing. Provision of the point light source so as to face a non-image area minimizes the influence of the point light source on the other steps of the image formation process including charging and exposure. As the point light source, an inexpensive and easily available component such as an LED lamp is usable. When an LED is used, the power consumption is reduced, and the size of the image formation apparatus is reduced. Thus, a highly reliable optical electric charge removal device can be realized.

In one embodiment of the invention, the optical conductor of the optical electric charge removal device is formed of an inexpensive and easily available light-transmissive material such as an acrylic resin. When such a material is used, the power consumption is reduced, and the size of the image formation apparatus is reduced. A light reflecting/scattering surface can be easily obtained by forming a convex and concave surface, for example, a prism-cut surface or bonding a whitened tape.

In one embodiment of the invention, even when the optical conductor is contaminated with scattered toner, the optical conductor only can be removed from the process cartridge and cleaned after the process cartridge is detached from the image formation apparatus. Even when the optical conductor is accommodated in a disposable process cartridge, the optical conductor can be easily separated from the process cartridge in a recycle process as long as the optical conductor does not have any significant damage such as a scratch or crack. In this case, the oils, toner or the like are removed from the optical conductor and the optical conductor is recycled.

In one embodiment of the invention, an inexpensive optical electric charge removal device for uniformly irradiating the surface of the photosensitive member can easily be realized.

In one embodiment of the invention, the light utilization efficiency of the point light source can be improved.

In one embodiment of the invention, the light from the point light source can be efficiently guided to the optical conductor. In addition, the incident light can be guided to the surface of the photosensitive member through the light outgoing surface of the optical conductor without the optical path being blocked. The optical conductor is separate from the point light source, and thus the point light source does not need to be detached even when the optical conductor is detached. Therefore, the electricity-related troubles such as defective connection are unlikely to occur, and the influence of the point light source on the optical path can be minimized. As a result, an optical electric charge removal device having improved reliability is obtained.

In one embodiment of the invention, the operability of the optical electric charge removal device can be improved.

In one embodiment of the invention, the operability of the optical electric charge removal device can be further improved.

In one embodiment of the invention, the light from the point light source can be efficiently guided to the light incident surf ace of the optical conductor without the light being scattered. Even in a structure where the point light source is provided in the main body of the image formation apparatus and the optical conductor is separately mounted on the detachable process cartridge, an optical path can be formed with certainty so as to guide the light emitted by the point light source to the light incident surf ace of the optical conductor. The adverse influences, caused by the point light source and the optical conductor being separately provided, on the assembly precision of the image formation apparatus and the process cartridge, and the positioning precision of attachment of the process cartridge to the image formation apparatus, are eliminated.

In one embodiment of the invention, the light from the point light source can be efficiently guided to the light incident surface of the optical conductor without the light being scattered. Even in a structure where the point light source is provided in the main body of the image formation apparatus and the optical conductor is separately mounted on the detachable process cartridge, an optical path can be formed with certainty so as to guide the light emitted by the point light source to the light incident surface of the optical conductor. The adverse influences, caused by the point light source and the optical conductor being separately provided, on the assembly precision of the image formation apparatus and the process cartridge, and the positioning precision of attachment of the process cartridge to the image formation apparatus, are eliminated.

In one embodiment of the invention, the light from the point light source can be efficiently guided to the light incident surface of the optical conductor without the light being scattered. Even in a structure where the point light source is provided in the main body of the image formation apparatus and the optical conductor is separately mounted on the detachable process cartridge, an optical path can be formed with certainty so as to guide the light emitted by the point light source to the light incident surface of the optical conductor. The adverse influences, caused by the point light source and the optical conductor being separately provided, on the assembly precision of the image formation apparatus and the process cartridge, and the positioning precision of attachment of the process cartridge to the image formation apparatus, are eliminated.

An image formation apparatus including the above-described optical electric charge removal device is also reduced in production costs and power consumption, and is efficient.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An optical electric charge removal device, mountable on an image formation apparatus of an electrophotographic system, for removing residual charges on a photosensitive member by light irradiation, the optical electric charge removal device comprising:

a light source provided in the image formation apparatus;

an optical conductor, mountable on a process cartridge which is detachable from the image formation apparatus, for forming an optical path for guiding light incident from the light source to the photosensitive member; and wherein the optical conductor is mounted on the process cartridge by a separable connection device.

2. An optical electric charge removal device according to claim 1, wherein the light source includes an LED lamp provided so as to face a leading end surface of the process cartridge inserted into the image formation apparatus, the light source being located so as to face a non-image area of the photosensitive member.

3. An optical electric charge removal device according to claim 2, wherein:

the optical conductor is formed of a light-transmissive material, the optical conductor has a smooth light incident surface for receiving light incident from the light source and a smooth light outgoing surface from which the light exits the photosensitive member, and the optical conductor has a light reflecting surface which faces the light outgoing surface and is roughened or provided with a whitened adhesive tape.

4. An optical electric charge removal device according to claim 1, wherein:

the optical conductor is formed of a light-transmissive material, the optical conductor has a smooth light incident surface for receiving light incident from the light source and a smooth light outgoing surface from which the light exits the photosensitive member, and the optical conductor has a light reflecting surface which faces the light outgoing surface and is roughened or provided with a whitened adhesive tape.

5. An image formation apparatus including an optical electric charge removal device according to claim 1.

6. An optical electric charge removal device according to claim 1, wherein:

in the optical conductor the light emitting plane is provided at a position apart for a distance larger than 50 mm from the light emitting plane of the light source.

7. An optical electric charge removal device according to claim 1, wherein:

the optical conductor has a shape of a strip extending parallel to the photosensitive member, a leading end surface of the optical conductor inserted into the image formation apparatus faces the light source so as to act as a light incident surface, a side surface of the optical conductor substantially perpendicular to the leading end surface and facing the photosensitive member acts as a light outgoing surface, a side surface of the optical conductor facing the light outgoing surface becomes closer to the light outgoing surface from the leading end surface toward a rear surface opposite to the leading end surface, and acts as a light reflecting surface for guiding light incident on the light incident surface to the light outgoing surface.

8. An optical electric charge removal device according to claim 7, wherein the light source faces the light incident surface, and has an optical axis which passes through an intersection of the light reflecting surface and the rear surface.

9. An optical electric charge removal device, mountable on an image formation apparatus of an electrophotographic system, for removing residual charges on a photosensitive member by light irradiation, the optical electric charge removal device comprising:

a light source provided in the image formation apparatus;

an optical conductor, provided separately from the light source, for forming an optical path for guiding light incident from the light source to the photosensitive member;

a support member for supporting the optical conductor at a position where only a light incident surface of the optical conductor contacts the light source and the optical conductor is out of contact with the image formation apparatus, the support member being provided so as to face an area of the photosensitive member outside of an image area; and wherein the optical conductor is mounted on the process cartridge by a separable connection device.

10. An optical electric charge removal device according to claim 9, wherein the optical conductor is mounted on a process cartridge detachable from the image formation apparatus, and the supporting member is provided on an area of the process cartridge which faces an area of the photosensitive member outside of an image area.

11. An optical electric charge removal device according to claim 9, wherein the optical conductor is detachable from the process cartridge.

12. An optical electric charge removal device according to claim 9, further comprising a light blocking member, formed of a flexible and elastic material, for blocking the light from the light source from being incident on an element other than the optical conductor.

13. An image formation apparatus including an optical electric charge removal device according to claim 9.

14. An optical electric charge removal device according to claim 9, wherein:

the support member is provided between the light reflecting plane and the light emitting plane of the optical conductor.

15. An optical electric charge removal device, mountable on an image formation apparatus of an electrophotographic system, for removing residual charges on a photosensitive member by light irradiation, the optical electric charge removal device comprising:

a light source provided in the image formation apparatus;

an optical conductor, provided separately from the light source, for forming an optical path for guiding light incident from the light source to the photosensitive member;

a support member for supporting the optical conductor at a position where only a light incident surface of the optical conductor contacts the light source and the optical conductor is out of contact with the image formation apparatus, the support member being provided so as to face an area of the photosensitive member outside of an image area; and a light blocking member for blocking the light from the light source from being incident on an element other than the optical conductor, the light blocking member being movable to be closer to or farther from the light incident surface of the optical conductor.

16. An optical electric charge removal device, mountable on an image formation apparatus of an electrophotographic system, for removing residual charges on a photosensitive member by light irradiation, the optical electric charge removal device comprising:

a light source provided in the image formation apparatus;

an optical conductor, provided separately from the light source, for forming an optical path for guiding light incident from the light source to the photosensitive member;

a support member for supporting the optical conductor at a position where only a light incident surface of the optical conductor contacts the light source and the optical conductor is out of contact with the image formation apparatus, the support member being provided so as to face an area of the photosensitive member outside of an image area; and a light blocking member integrally formed with the light source, wherein an assembly of the light source and the light blocking member is movable to be closer to or farther from the light incident surface of the optical conductor.

* * * * *